US006720287B2

(12) United States Patent
Ito

(10) Patent No.: US 6,720,287 B2
(45) Date of Patent: Apr. 13, 2004

(54) HEAT SENSITIVE RECORDING MATERIAL AND MICROCAPSULE SOLUTION

(75) Inventor: Koreshige Ito, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 118 days.

(21) Appl. No.: 10/167,405

(22) Filed: Jun. 13, 2002

(65) Prior Publication Data

US 2003/0045426 A1 Mar. 6, 2003

(30) Foreign Application Priority Data

Jun. 15, 2001 (JP) ..... 2001-182061

(51) Int. Cl.[7] ..... B41M 5/20
(52) U.S. Cl. ..... 503/218; 503/200
(58) Field of Search ..... 503/218, 200

(56) References Cited

FOREIGN PATENT DOCUMENTS

| | | |
|---|---|---|
| JP | 08-324129 | 12/1996 |
| JP | 2002-144740 | 5/2002 |

*Primary Examiner*—N. Edwards
(74) *Attorney, Agent, or Firm*—Sughrue Mion, PLLC

(57) ABSTRACT

The present invention discloses a heat-sensitive recording material comprising a thermal recording layer disposed on a substrate which layer contains at least a diazonium salt compound and a coupler which has a coupling reaction with the diazonium salt compound to develop a color, wherein the thermal recording layer microcapsules, which encapsulate the diazonium salt compound, an aromatic carboxylate represented by the following general formula (I) and an aromatic carboxylate represented by the following general formula (II).

General formula (I)

General formula (II)

19 Claims, No Drawings

HEAT SENSITIVE RECORDING MATERIAL AND MICROCAPSULE SOLUTION

BACKGROUND OF THE INVENTION

1. Field of the Invention

The present invention relates to a heat-sensitive recording material and a microcapsule solution, and more particularly relates to a diazo-compound-based heat-sensitive recording material that is fixable and superior in shelf life, and a microcapsule solution used in the heat-sensitive recording material.

2. Description of the Related Art

A heat-sensitive recording material, which has images recorded thereon by applying heat applied thereto with a thermal head or the like, is comparatively inexpensive, and recording devices therefor are simple, highly reliable and do not require maintenance.

Under the condition, particularly in recent years, there has been a strong demand to make this recording material high performance by improving high image quality and storage stability and the like. Research has been vigorously carried out on properties, such as coloring density, image quality and shelf life, of the heat-sensitive recording material.

However, in general, in the case of a heat-sensitive recording material containing a diazonium salt compound as coloring component, since the activity of the diazonium salt compound is very high, the diazonium salt compound gradually thermal decomposes, even in a dark place, and loses reactivity. The resulting disadvantage is a short shelf life as the heat-sensitive recording material. Moreover, when a diazonium salt compound is decomposed, various products of a photodecomposition reaction are generated. Thus, a coloring, which is called a photodecomposition stain, is easily generated, causing serious degradation in whiteness in base surface portions.

One of the methods for solving this disadvantage is to encapsulate the diazonium salt compound into microcapsules. This method separates the diazonium salt compound from water, bases and the like, which accelerating decomposition. Therefore, it is possible to greatly improve the shelf life as the recording material (see, Usami, Tomomasa, et al. Journal of Electronic Photographic Society, Vol. 26, 2 (1987) pp. 115 to 125).

Moreover, when the glass transition temperature of the capsule wall is slightly higher than room temperature (thermal responsive microcapsules), the capsule exhibits a substance non-permeability at room temperature, while it exhibits a substance permeability at temperatures higher than the glass transition temperature. For this reason, by encapsulating the diazonium salt compound using the above-mentioned capsule wall with a coupler, a base and the like being disposed outside the capsule, it is possible to store the diazonium salt compound stably for a long time, to easily form colored images by heating the microcapsules and also to fix (photo-fix) the images through light irradiation.

However, the decomposition of the diazonium salt compound cannot be completely prevented even by using the microcapsules. It is not possible to avoid the coloring due to photodecomposition stain caused by the existence of various photodecomposition products. This results in degradation in whiteness of the recording surface of the heat-sensitive recording material, causing not only degradation in the recording material, but also serious reduction in the image contrast due to the high base surface density in a resulting image, and a resultant degradation of the image quality.

However, if one simply reduces the reactivity of the diazonium salt compound, the coloring density tends to be lowered as well. Therefore, it is necessary to improve the whiteness while maintaining the coloring property.

In recent years, in order to solve these problems with coloring, increasing the whiteness in a recording surface to be recorded and the stability in storage (shelf life, herein shelf life refers to shelf life of an unrecorded recording material) with respect to the whiteness, and improving the whiteness in non-image portions (base surface portion) after recording (after photo-fixing),various research has been performs.

For example, Japanese Patent Application Laid-Open (JP-A) No. 8-324129 has proposed a technique in which an aromatic carboxylate such as diphenylphthalate, is encapsulated in a microcapsule together with a diazonium salt compound.

When the aromatic carboxylate is encapsulated in the microcapsule together with the diazonium salt compound, and utilized, it becomes possible to reduce the generation of photodecomposition stain, and also to provide a heat-sensitive recording material that has superior shelf life and base surface coloring. However, a solution which contains the microcapsules (hereinafter, referred to as "microcapsule solution"), which is encapsulated the diazonium salt compound and the aromatic carboxylate such as diphenylphthalate, has a problem in that, as time passes, the deposition of crystals occurs during the storage, etc. These crystals cause various problems. For example, when a microcapsule solution, which contains crystals that have grown to approximately dozens of microns, is used as a coating solution, and applied as it is, there is a significant degradation of the coated surface. Therefore, in order to ensure a uniform coated surface, the coating solution comprising the microcapsule solution is coated after the above-mentioned crystals and the like have been removed using a filter having a mesh size of several microns to dozens of microns. However, if a great amount of residue is filtered by the filtering process, that is, if there is a great amount of crystals, clogging occurs in the filter to cause a failure in transporting the solution, resulting in a deterioration of the quality of the recording material and the production efficiency.

SUMMARY OF THE INVENTION

Recently, there has been a strong demand for increasing high performance, such as high image quality and stability in storage (in particular, shelf life. However, at present a heat-sensitive recording material has not been provided, which: comprises a recording surface (base surface portion), which has high whiteness while maintaining coloring properties; has a superior storage stability, which does not damage the whiteness of the base surface portion for a long period of time; stably forms an image having high contrast with white non-image portions while suppressing crystallization when a microcapsule solution is being stored, to obtain superior production efficiency.

The present invention provides a heat-sensitive recording material which has the superior whiteness in the non-image portions (base surface portions) and storage stability (shelf life) with respect to the whiteness, and forms a clear image with high contrast in a stable manner, with high production efficiency, and a microcapsule solution which can reduce crystallization over time, and is superior in storage stability in order to solve the above-mentioned conventional problems.

The above-mentioned objects can be achieved by the following means.

A first aspect of the present invention provides a heat-sensitive recording material comprising: a substrate; a thermal recording layer disposed on said substrate, which thermal recording layer contains a diazonium salt compound and a coupler that has a coupling reaction with the diazonium salt compound to develop a color; an aromatic carboxylate represented by the following general formula (I); and an aromatic carboxylate represented by the following general formula (II); wherein the diazonium salt compound is encapsulated in microcapsules together with the aromatic carboxylate represented by the general formula (I) and the aromatic carboxylate represented by the general formula (II);

General formula (I)

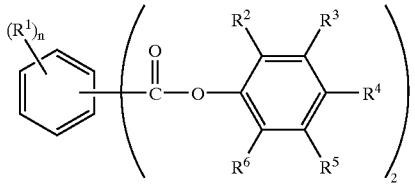

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloakyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4;

General formula (II)

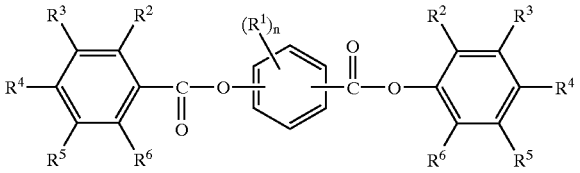

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $l^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4.

A second aspect of the present invention provides a heat-sensitive recording material according to the first aspect, wherein the mass ratio (x/y) of the aromatic carboxylate (x) represented by the general formula (I) to the aromatic carboxylate (y) represented by the general formula (II) comprises 30/70 to 70/30.

A third aspect of the present invention provides a thermal recording material according to the first aspect, wherein the melting points of each of the aromatic carboxylates is not more than 150° C.

A fourth aspect of the present invention provides a thermal recording material according to the first aspect, wherein a total amount of the aromatic carboxylate comprises 50 to 500% by mass relative to the diazonium salt compound.

A fifth aspect of the present invention provides a thermal recording material according to the first aspect, the microcapsules further comprising one kind of at least thermal acid-generating agent selected from arylalkylsulfonyl compounds and dialkyl sulfate compounds.

A sixth aspect of the present invention provides a thermal recording material according to the fifth aspect, wherein a total amount of the thermal acid-generating agent is 10 to 200% by mass relative to the diazonium salt compound.

A seventh aspect of the present invention provides a thermal recording material according to the first aspect, wherein the microcapsules are manufactured by an interface polymerization method.

An eighth aspect of the present invention provides a thermal recording material according to the first aspect, wherein a particle size of the microcapsules is 0.1 to 2.0 $\mu$m.

A ninth aspect of the present invention provides a thermal recording material according to the first aspect, wherein an amount of the coupler in the thermal recording layer is 0.1 to 30 parts by mass relative to 1 part by mass of diazonium salt compound.

A tenth aspect of the present invention provides a thermal recording material according to the first aspect, wherein a coated amount of the diazonium compound in the thermal recording layer is 0.05 to 2 g/m$^2$.

An eleventh aspect of the present invention provides a thermal recording material according to the first aspect, wherein the thermal recording layer further comprises an organic base, an intensifier, a binder and an antioxidant.

A twelfth aspect of the present invention provides a microcapsule solution for comprising an aromatic carboxylate represented by the following general formula (I), an aromatic carboxylate represented by the following general formula (II), and a diazonium salt compound in microcapsules of the microcapsule solution;

General formula (I)

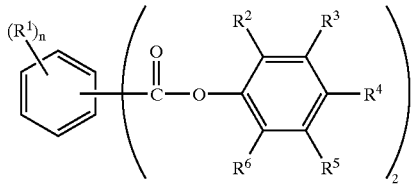

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4;

General formula (II)

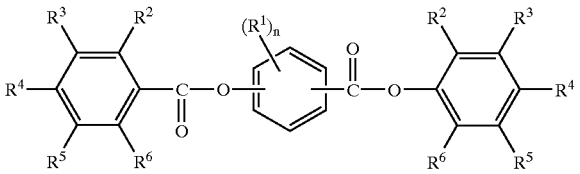

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4.

A thirteenth aspect of the present invention provides a microcapsule solution according to the twelfth aspect, wherein the mass ratio (x/y) of the aromatic carboxylate (x) represented by the general formula (I) to the aromatic carboxylate (y) represented by the general formula (II) is 30/70 to 70/30.

A fourteenth aspect of the present invention provides a microcapsule solution according to the twelfth aspect, wherein a melting point of the aromatic carboxylate in the microcapsule solution is not more than 150° C.

A fifteenth aspect of the present invention provides a microcapsule solution according to the twelfth aspect, wherein a total amount of the aromatic carboxylate comprises 50 to 500% by mass relative to the diazonium salt compound.

A sixteenth aspect of the present invention provides a microcapsule solution according to the twelfth aspect, further comprising, in the microcapsules, at least one kind of thermal acid-generating agent selected from arylalkylsulfonyl compounds and dialkyl sulfate compounds.

A seventeenth aspect of the present invention provides a microcapsule solution according to the sixteenth aspect, wherein a total amount of the thermal acid-generating agent is 10 to 200% by mass, relative to the diazonium salt compound.

An eighteenth aspect of the present invention provides a microcapsule solution according to the twelfth aspect, wherein the microcapsules are manufactured by an interface polymerization method.

An nineteenth aspect of the present invention provides a microcapsule solution according to the twelfth aspect, wherein a particle size of the microcapsules is 0.1 to 2.0 $\mu$m.

DESCRIPTION OF THE PREFERRED EMBODIMENTS

Below, a heat-sensitive recording material and a microcapsule solution of the present invention will be explained in detail.

<<Thermal Recording Material>>

The heat-sensitive recording material of the present invention comprises a thermal recording layer disposed on a substrate which the thermal recording layer contains a diazonium salt compound, a coupler which has coupling reaction with the diazonium salt compound to develop a color, an aromatic carboxylate represented by the following general formula (I) and an aromatic carboxylate represented by the following general formula (II); wherein the diazonium salt compound is encapsulated in the microcapsules of the thermal recording layer together with the aromatic carboxylate represented by the following general formula (I) and the aromatic carboxylate represented by the following general formula (II).

General formula (I)

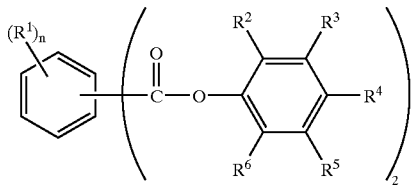

General formula (II)

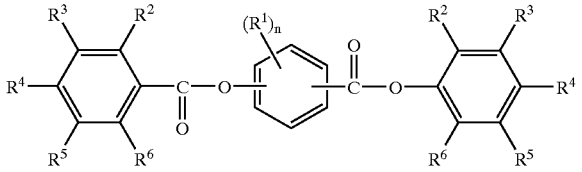

In the heat-sensitive recording material of the present invention, a diazonium salt compound, an aromatic carboxylate represented by the above-mentioned general formula (I) and an aromatic carboxylate represented by the above-mentioned general formula (II) are encapsulated in the same microcapsule. Thus, it is possible to suppress the generation of photodecomposition stains in the heat-sensitive recording material, and the present invention can provide a heat-sensitive recording material, which has an extremely superior whiteness and a raw preserving property that can maintain this whiteness stably for a long time, and superior shelf life stability that is less susceptible to influences, such as storage environments. Moreover, the aromatic carboxylate represented by the above-mentioned general formula (I) and the aromatic carboxylate represented by the above-mentioned general formula (II) are encapsulated together with in a microcapsule. Thus it is possible to suppress crystallization in the microcapsule solution, and consequently to improve the preserving stability in the solution.

Thus, since it is possible to reduce residue from filtering the microcapsule solution, clogging of the filter is eliminated and the production efficiency of the heat-sensitive recording material is improved.

The heat-sensitive recording material of the present invention comprises a thermal recording layer on a substrate. The thermal recording layer may be either a single layer or a plurality of layers, and may have other layers, such as a layer adjusting light transmittance and a protection layer, if necessary.

<Thermal Recording Layer>

The above-mentioned thermal recording layer contains a diazonium salt compound, a coupler which has a coupling reaction with the diazonium salt compound to develop a color, an aromatic carboxylate represented by the above-mentioned general formula (I) and an aromatic carboxylate represented by the above-mentioned general formula (II). It may also contain other components, such as a thermal acid-generating agent and a base, if necessary.

(Aromatic carboxylate)

In the present invention, in the microcapsules enclosing the diazonium salt compound, an aromatic carboxylate represented by the above-mentioned general formula (I) and an aromatic carboxylate represented by the above-mentioned general formula (II) are contained. Here, in formulae (I) and (II), a phenyl group and substituents ($R^2$ to $R^6$) which substitute the phenyl group are respectively independent, and may be the same or different from each other.

In the above-mentioned general formulae (I) and (II), $R^1$ represents a halogen atom, an alkyl group having 1 to 20 carbon atoms, an alkenyl group having 2 to 20 carbon atoms, an aralkyl group having 7 to 20 carbon atoms, an alkoxy group having 1 to 20 carbon atoms, an alkylcarbonyl group having 2 to 20 carbon atoms, an alkylcarbonyloxy group having 2 to 20 carbon atoms, an alkyloxycarbonyl group having 2 to 20 carbon atoms, a cycloalkyl group having 5 to 20 carbon atoms or an aryl group having 6 to 20 carbon atoms.

Examples of the halogen atom include chlorine, bromine and fluorine atoms. Among these, the chlorine atom is preferable.

Examples of the alkyl group having 1 to 20 carbon atoms include methyl groups, ethyl groups, n-propyl groups, isopropyl groups, n-butyl groups, t-butyl groups, n-octyl groups, 2-ethylhexyl groups and n-dodecyl groups. Among these, alkyl groups having 1 to 8 carbon atoms are preferable. A methyl group and an ethyl group are more preferable.

Examples of the alkenyl group having 2 to 20 carbon atoms include vinyl groups and allyl groups.

Examples of the aralkyl group having 7 to 20 carbon atoms include a benzyl groups, a methoxybenzyl groups and α-methylbenzyl groups.

Examples of the alkoxy group include methoxy groups, ethoxy groups, n-propyloxy groups, isopropyloxy groups, n-butyloxy groups, t-butyloxy groups, n-octyloxy groups, 2-ethylhexyloxy groups, n-dodecyloxy groups. Among these, alkoxy groups having 1 to 8 carbon atoms are preferable. Methoxy groups and ethoxy groups are more preferable.

Examples of the alkylcarbonyl group having 2 to 20 carbon atoms include acetyl groups, propanoyl groups and butanoyl groups.

Examples of the alkylcarbonyloxy group include acyl groups and benzoyl groups.

Examples of the alkyloxycarbonyl group include methoxycarbonyl groups, ethoxycarbonyl groups, n-propyloxycarbonyl groups, isopropyloxycarbonyl groups, n-butyloxycarbonyl groups and t-butyloxycarbonyl groups. Among these, alkyloxycarbonyl groups having 2 to 9 carbon atoms are preferable. Methoxycarbonyl groups and ethoxycarbonyl groups are more preferable.

Examples of the cycloalkyl group having 5 to 20 carbon atoms include cyclopentyl groups and cyclohexyl groups.

Examples of the aryl group having 6 to 20 carbon atoms include phenyl groups, 4-methylphenyl groups, 3-methylphenyl groups, 2-methylphenyl groups, 4-chlorophenyl groups and 2-chlorophenyl groups.

The above-mentioned alkyl groups, alkenyl groups, aralkyl groups, alkoxy groups, alkylcarbonyl groups, alkylcarbonyloxy groups, alkyloxycarbonyl groups, cycloalkyl groups and aryl groups may respectively have substituents.

Examples of the substituents include halogen atoms, alkyl groups, aryl groups, alkoxy groups, alkyloxycarbonyl groups and aryloxycarbonyl groups.

Here, n in the general formulae (I) and (II) represents an integer of 0 to 4. When n represents an integer not less than 2, the above-mentioned $R^1$s may be the same or different from each other, $R^1$s which bond to two adjacent carbon atoms in an aromatic ring may bond to each other to form an aliphatic ring, an aromatic ring or a heterocyclic ring. The aliphatic ring, aromatic ring and heterocyclic ring may respectively have substituents.

In the general formulae (I) and (II), $R^2$, $R^3$, $R^4$, $R^5$ and $R^6$ each independently represents a hydrogen atom, a halogen atom, an alkyl group having 1 to 20 carbon atoms, an alkenyl group having 2 to 20 carbon atoms, an aralkyl group having 7 to 20 carbon atoms, an alkoxy group having 1 to 20 carbon atoms, an alkylcarbonyl group having 2 to 20 carbon atoms, an alkylcarbonyloxy group having 2 to 20 carbon atoms, a cycloalkyl group having 5 to 20 carbon atoms, or an aryl group having 6 to 20 carbon atoms.

The above-mentioned halogen atom, alkyl group, alkenyl group, aralkyl group, alkoxy group, alkylcarbonyl group, alkylcarbonyloxy group, cycloalkyl group and aryl group, represented by $R^2$ to $R^6$, are the same as those in $R^1$, and each of them may have substituents.

Moreover, each of the pairs of $R^2$ and $R^3$, $R^3$ and $R^4$, $R^4$ and $R^5$, $R^5$ and $R^6$ may bond to each other to form an aliphatic ring, an aromatic ring or a heterocyclic ring. The aliphatic ring, aromatic ring and heterocyclic ring may have substituents respectively.

Examples of the aromatic carboxylate represented by the above-mentioned general formula (I) include diphenylphthalates and derivatives thereof. More specifically, diphenyl isophthalates, di-p-tolyl phthalates, di-m-tolyl phthalates, bis(4-methoxyphenyl)phthalates, bis(4-butylphenyl)phthalates, bis(4-chlorophenyl)phthalates, triphenyl-1,3,5-benzenetricarboxylates, triphenyl-1,2,4-benzenetricarboxylates, 2-naphthylphthalates, and the like, are preferable.

Among these, diphenylphthalates and derivatives thereof are more preferable from the viewpoint of compatibility with diazonium salt compounds.

Examples of the aromatic carboxylates represented by the general formula (II) include 2-benzoyloxy phenylbenzoates, 2-(2-chlorobenzoyloxy) phenylbenzoates, 2-(4-methylbenzoyloxy) phenylbenzoates, 2-(3-chlorobenzoyloxy) phenylbenzoates, 2-(2-methylbenzoyloxy) phenylbenzoates, 2-(4-chlorobenzoyloxy) phenylbenzoates, 2-(2-methoxybenzoyloxy) phenylbenzoates, 2-(4-methoxybenzoyloxy) phenylbenzoates, 2-(3-methoxybenzoyloxy) phenylbenzoates, 2-(3-bromobenzoyloxy) phenylbenzoates, 2-benzoyloxy (3-methylphenyl)benzoates, 2-(n-pentylcarbonyloxy) phenylbenzoates, 2-benzoyloxy (2-methylphenyl)benzoates, 2-(benzylcarbonyloxy) phenylbenzoates, 2-benzoyloxy (4-methylphenyl)benzoates, 2-benzoyloxy (4-chlorophenyl) benzoates, 2-benzoyloxy (2-chlorophenyl)benzoates, 2-(2-methylbenzoyloxy) (4-methylphenyl)benzoates, 2-(3-chlorobenzoyloxy) (4-methylphenyl)benzoates, 3-phenyl-2-benzoyloxy phenylbenzoates, 3-benzoyloxy phenylbenzoates, 3-benzoyloxy (4-methylphenyl)benzoates, 4-benzoyloxy phenylbenzoates, 4-(2-methylbenzoyloxy) phenylbenzoates, and 4-(4-methylbenzoyloxy) phenylbenzoates. Among these, 2-benzoyloxy phenylbenzoates, 2-(2-methylbenzoyloxy) phenylbenzoates and 2-benzoyloxy (2-methylphenyl)benzoates are preferable.

The following description will show specific examples of aromatic carboxylates (exemplified compounds (2) to (15)) represented by the general formula (I) and specific examples of aromatic carboxylates (exemplified compounds (1) and N–1 to N–41) represented by the general formula (II). However, the compounds are not limited to the examples.

(1)

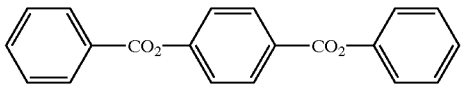

(2)

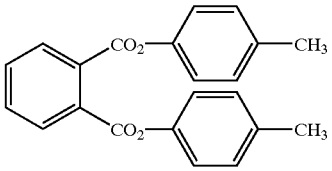

(3)

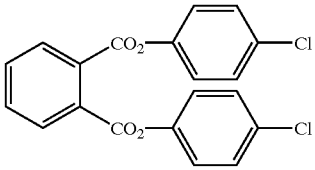

(4)

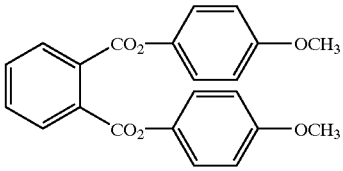

(5)

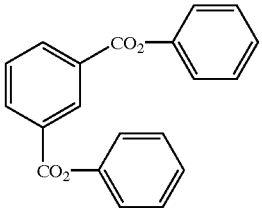

-continued (6)

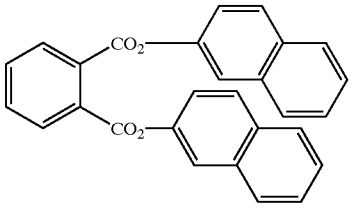

(7)

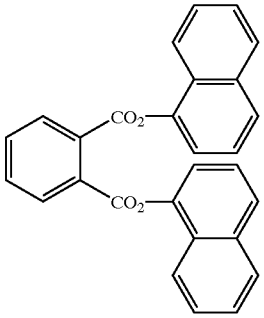

(8)

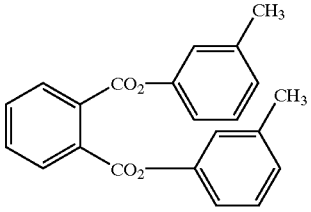

(9)

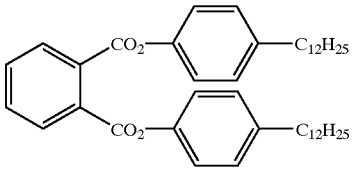

(10)

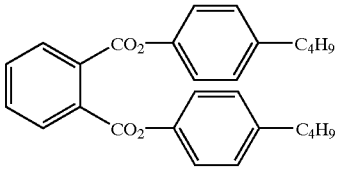

(11)

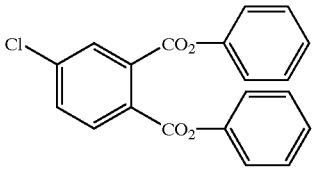

(12)

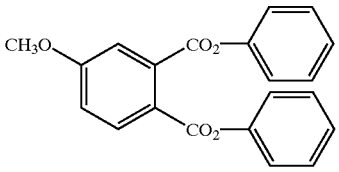

-continued
(13)
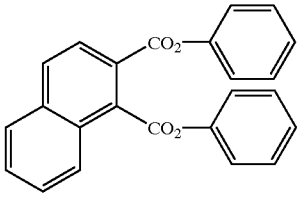
(14)
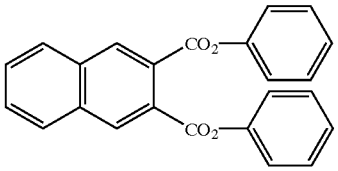
(15)
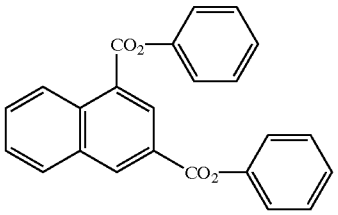
N-1
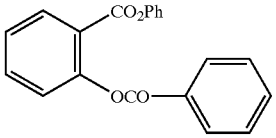
N-2
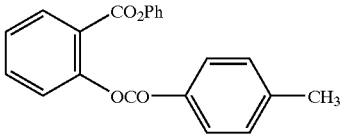
N-3
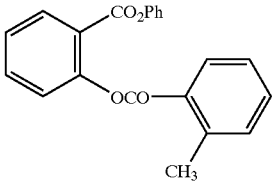
N-4
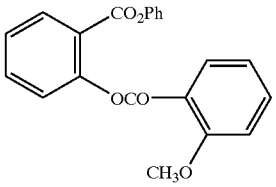
N-5
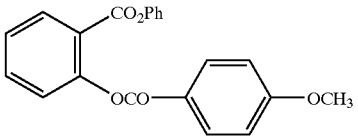
N-6
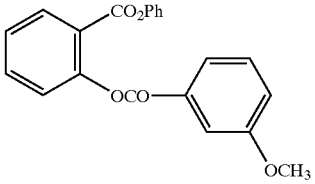
-continued
N-7
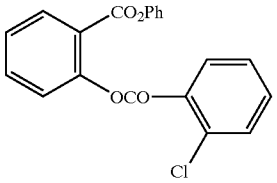
N-8
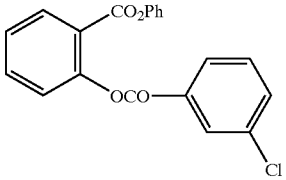
N-9
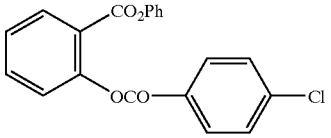
N-10
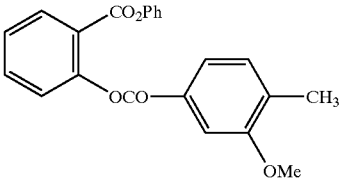
N-11
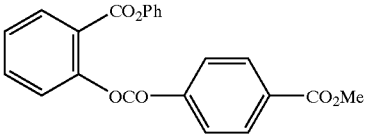
N-12
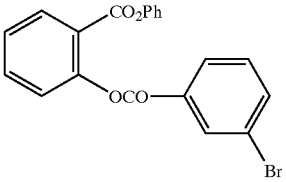
N-13
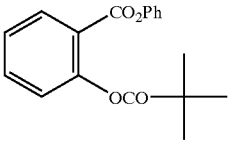
N-14
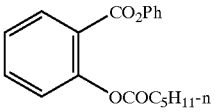
N-15
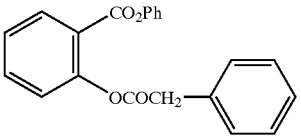

-continued
N-16
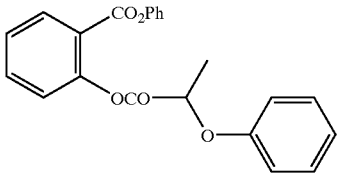
N-17
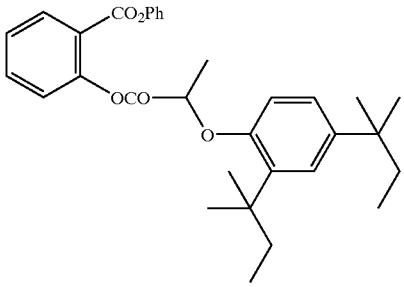
N-18
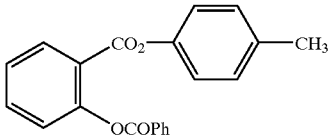
N-19
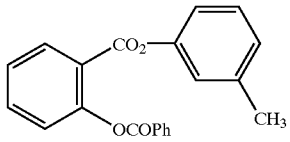
N-20
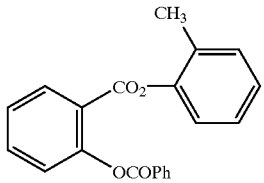
N-21
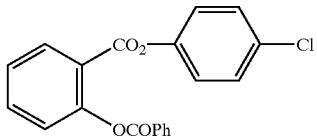
N-22
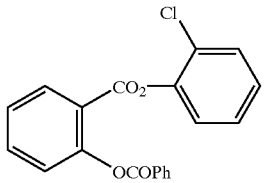
N-23
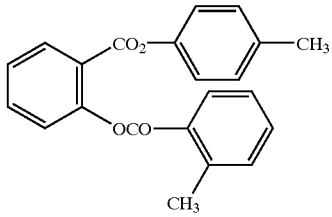
-continued
N-24
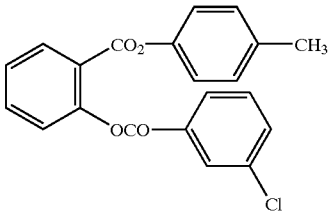
N-25
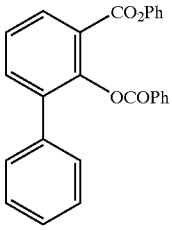
N-26
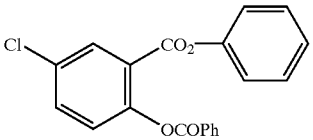
N-27
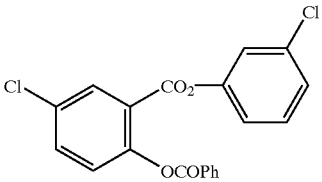
N-28
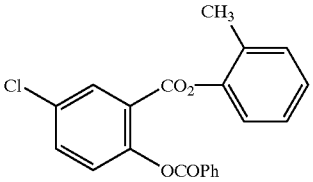
N-29
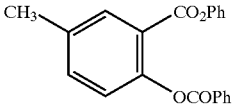
N-30
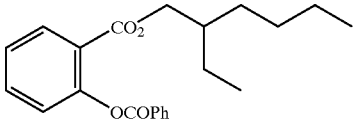
N-31
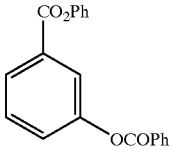
N-32
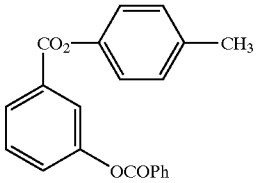

-continued

N-33

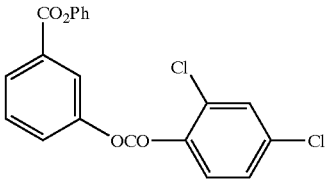

N-34

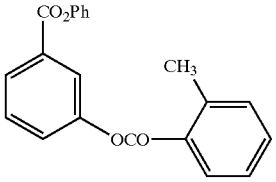

N-35

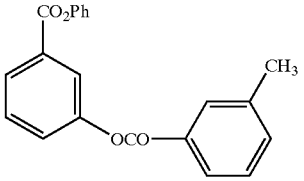

N-36

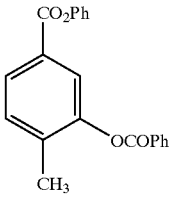

N-37

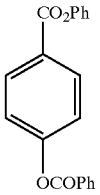

N-38

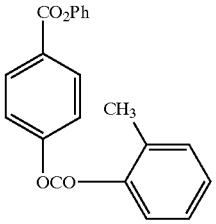

N-39

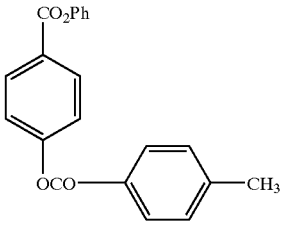

-continued

N-40

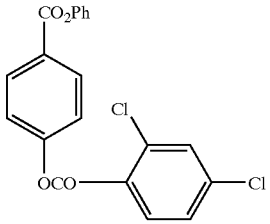

N-41

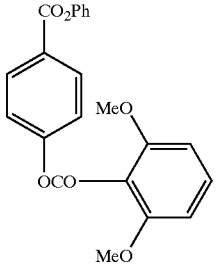

N-42

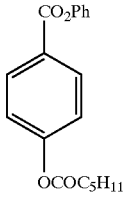

N-43

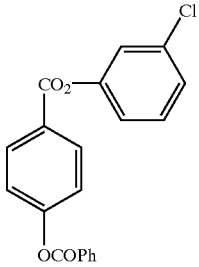

N-44

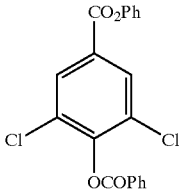

The aromatic carboxylates represented by the general formulae (I) and (II) are contained in the microcapsule as a core substance for the microcapsules and a diazonium salt compound. From the viewpoint of prevention of deposition of crystals at the time of a capsule manufacturing process (as microcapsule solution), the aromatic carboxylates preferably having a melting point of not more than 150° C., and those having a melting point of not more than 130° C. are more preferable.

Examples of the aromatic carboxylate having a melting point of not more than 150° C. include diphenylphthalates (having a melting point of 74 to 76° C., hereinafter, only the melting point is indicated within parentheses), di-p-tolyl phthalates (83 to 85° C.), bis(4-chlorophenyl)phthalates (112.5 to 114° C.), bis(4-methoxyphenyl)phthalates (95 to 96.5° C.), bis(4-dodecylphenyl)phthalates (not more than room temperature), bis(4-butylphenyl)phthalates (not more than room temperature), bis(4-propyonylphenyl)phthalates (128 to 130° C.), bis(4-methoxycarbonylphenyl)phthalates (126 to 128° C.), phenyl-2-benzoyloxybenzoates (81 to 84° C.).

In the present invention, each of the aromatic carboxylates represented by formulae (I) and (II) may be used alone, or two or more kinds may be used in combination.

A total amount of the aromatic carboxylates represented by formulae (I) and (II) is preferably 50 to 500% by mass and more preferably, 100 to 300% by mass relative to a diazonium salt compound which will be described later. If the content is less than 50% by mass, the whiteness (shelf life) of the base surface portion tends to deteriorate during raw storage, while if the content exceeds 500% by mass, the coloring density may be reduced.

The mass ratio (x/y) of the aromatic carboxylate (x) represented by formula (I) to the aromatic carboxylate (y) represented by formula (II) is preferably 30/70 to 70/30, more preferably, 60/40 to 40/60, and most preferably, 55/45 to 45/55. When the mass ratio is in the range of 30/70 to 70/30, deposition of crystals does not occur, and it is possible to sufficiently reduce the generation of residues in the microcapsule solution.

(Thermal Acid-generating Agent)

In the present invention, a thermal acid-generating agent may be contained in the microcapsules. Here, the "thermal acid-generating agent" refers to a compound which is hydrolyzed to generate an acid by a passage of a period time or due to heat.

By enclosing the diazonium salt compound in the microcapsules together with the aromatic carboxylate and the thermal acid-generating agent, it is possible to further improve the whiteness in non-image portions and the shelf life, which maintains the whiteness stably for a long time.

The thermal acid-generating agent may be selected from known compounds which can generate an acid after the passage of a period time or due to heat.

In particular, a compound selected from arylalkylsulfonyl compounds represented by the following general formula (III) and dialkylsulfate compounds represented by the following general formula (IV) are preferable.

Arylalkylsulfonyl compound $$Ar—SO_2—R \qquad \text{General Formula (III)}$$

in which Ar represents an aryl group, and R represents an alkyl group, a cycloalkyl group or an aralkyl group.

The aryl group, the alkyl group, the cycloalkyl group and the aralkyl group mentioned above may be respectively substituted by a halogen atom, an alkoxy group, an acylamino group, an acyl group, a sulfonyl group, a nitrile group, an alkoxycarbonyl group, a carbamoyl group, a nitro group, or the like.

For the aryl group, examples include aryl groups having 6 to 20 carbon atoms, specifically phenyl groups, 4-methylphenyl groups, 3-methylphenyl groups, 2-methylphenyl groups, 4-chlorophenyl groups and naphthyl groups. Among these, aryl groups having 6 to 12 carbon atoms are preferable, and phenyl groups, 4-methylphenyl groups and 2-methylphenyl groups are more preferable.

Examples of the alkyl groups are alkyl groups having 1 to 12 carbon atoms specifically methyl groups, ethyl groups, n-propyl groups, isopropyl groups, n-butyl groups, tert-butyl groups, n-octyl groups, 2-ethylhexyl groups and n-dodecyl groups. In particular, alkyl groups of carbon atoms of 1 to 4 are preferable, and methyl groups and ethyl groups are more preferable.

Examples of the cycloalkyl group include cyclopentyl groups and cyclohexyl groups.

Examples of the aralkyl group include aralkyl groups having 7 to 20 carbon atoms, specifically benzyl groups, methoxybenzyl groups and (α-methylbenzyl groups.

The total number of carbon atoms of the arylalkylsulfonyl compound represented by formula (III) is preferably 7 to 40, and more preferably, 7 to 25.

Specific examples of the arylalkylsulfonyl compounds represented by formula (III) are given below; however, these compounds are not limited to these examples; methylbenzene sulfonates, ethylbenzene sulfonates, propylbenzene sulfonates, methyl p-toluene sulfonates, methyl o-toluene sulfonates, ethyl p-toluene sulfonates, ethyl o-toluene sulfonates, methylnaphthalene sulfonates, ethyl 4-methoxybenzene sulfonates, 2-butoxyethyl p-toluene sulfonates, 2-phenoxyethyl benzene sulfonates, benzyl 3-methoxycarbonylbenzene sulfonates, 2-nitroethyl benzene sulfonates and 3-acetaminopropyl p-toluene sulfonates.

Dialkyl sulfate compound $$R'O—SO_2—OR' \qquad \text{General Formula (IV)}$$

in which R' represents an alkyl group having not more than 24 carbon atoms or a cycloalkyl group having not more than 24 carbon atoms, and may be further substituted by an aryl group, an alkoxy group, an aryloxy group, an alkylthio group, an arylthio group, a nitro group or a halogen atom.

Examples of the alkyl group having not more than 24 carbon atoms include: methyl groups, ethyl groups, n-propyl groups, isopropyl groups, n-butyl groups, tert-butyl groups, iso-pentyl groups, n-octyl groups, 2-ethylhexyl groups, n-nonyl groups, n-dodecyl groups, octadecyl groups and stearyl groups. In particular, alkyl groups having 2 to 12 carbon atoms are preferable, alkyl groups having 2 to 6 carbon atoms are more preferable, and ethyl groups, n-propyl groups and n-butyl groups are most preferable.

Examples of the cycloalkyl groups having not more than 24 carbon atoms include cyclopentyl groups and cycloalkyl groups.

Specific examples of the dialkyl sulfate compounds represented by formula (IV) are given below; however, these compounds are not limited to these examples: diethyl sulfates, di-n-propyl sulfates, di-n-butyl sulfates, bis(2-ethylhexyl) sulfates, dilauryl sulfates, distearyl sulfates, bis(2-phenetyl) sulfates, bis(α-naphthylmethyl) sulfates, dibenzyl sulfates, bis(2butoxyethyl) sulfates, bis(2-phenoxyethyl) sulfates, bis(2-octylthioethyl) sulfates, bis[2-(4-tolyl)thioethyl]sulfates, bis(4-nitroethyl) sulfates, bis(2-chloroethyl) sulfates, dicyclohexyl sulfates, bis(4-methylcyclohexyl) sulfates, bis(4-methoxycyclohexyl) sulfates and bis(4-butylthiocyclohexyl) sulfates.

In the present invention, at least one kind of the thermal acid-generating agent represented by the general formula (III)or the formula (IV) may be used alone or two or more kinds may be used in combination.

A total amount of the thermal acid-generating agent is preferably 10 to 200% by mass, more preferably, 20 to 100% by mass, relative to a diazonium salt compound which will be described later.

If the content is less than 10% by mass, the whiteness in non-image portions (base surface portion) tends to degrade and the whiteness during raw storage may decrease significantly, while if the content exceeds 200% by mass, increased fogging tends to occur during raw storage.

When the diazonium salt compound and the thermal acid-generating agent are encapsulated in the microcapsules together with the aromatic carboxylates represented by formulae (I) and (II), the mass ratio (x:y) of the amount (x) of the aromatic carboxylates to the thermal acid-generating agent (y) is preferably 20:1 to 1:2, and more preferably, 10:1 to 1:1.

In the present invention, because a diazonium salt compound, which is a coloring component and will be described later, is encapsulated in the microcapsule together with the aromatic carboxylates represented by formulae (I) and (II) and the thermal acid-generating agent, it becomes possible to greatly improve the whiteness in non-image portions (base surface portion) and the shelf life with respect to the whiteness, in comparison with a case in which either the aromatic carboxylates or the thermal acid-generating agent is used in combination with the diazonium salt. Consequently, it becomes possible to maintain white color on non-image portions without being color stained and stably form a clear image with high contrast.

(Diazonium salt compound)

Examples of the diazonium salt compound include compounds represented by the following general formula (1):

$$Ar—N_2^+X^- \quad (1)$$

in which Ar represents an aromatic portion, and $X^-$ represents an acidic anion.

The diazonium salt compound has a coupling reaction with a coupler, which will be described later, by heating, to develop colors, or is decomposed by light. The diazonium salt compound can control a maximum absorbency wavelength by altering a site and kind of the substituent of an Ar portion.

Specific examples of the diazonium forming a salt include: 4-(p-tolylthio)-2,5-dibutoxybenzenediazoniums, 4-(4-chlorophenylthio)-2,5-dibutoxybenzenediazoniums, 4-(N,N-dimethylamino)benzenediazoniums, 4-(N,N-diethylamino) benzenediazoniums, 4-(N,N-dipropylamino) benzenediazoniums, 4-(N-methyl-N-benzylamino) benzenediazoniums, 4-(N,N-dibenzylamino) benzenediazoniums, 4-(N-ethyl-N-hydroxyethylamino) benzenediazoniums, 4-(N,N-diethylamino)-3-methoxybenzenediazoniums, 4-(N,N-dimethylamino)-2-methoxybenzenediazoniums, 4-(N-benzoylamino)-2,5-diethoxybenzenediazoniums, 4-morpholino-2,5-dibutoxybenzenediazoniums, 4-anilinobenzenediazoniums, 4-[N-(4-methoxybenzoyl)amino]-2,5-diethoxy benzenediazoniums, 4-pyrrolidino-3-ethylbenzenediazoniums, 4-[N-(1-methyl-2-(4-methoxyphenoxy)ethyl)-N-hexylamino]-2-hexyloxy benzenediazoniums, 4-[N-(2-(4-methoxyphenoxy)ethyl)-N-hexylamino]-2-hexyloxy benzenediazoniums, 2-(1-ethylpropyloxy)-4-[di(di-n-butylaminocarbonylmethyl) amino]benzenediazoniums, and 2-benzylsulfonyl-4-[N-methyl-N-(2-octanoyloxyethyl)]amino benzenediazoniums.

The maximum absorbency wavelength λmax of the diazonium salt compound is preferably no more than 450 nm, and more preferably, 290 to 440 nm. If the λmax is exceeds 450 nm, the shelf life might deteriorate. While if the λmax is less the above-mentioned wavelength range, the image fixing property and the image preserving property might deteriorate in combination with a coupler, or the hue might deteriorate.

Moreover, the diazonium salt compound preferably has no less than 12 carbon atoms, a solubility of not more than 1% in water, and a solubility of not less than 5% in ethyl acetate.

One kind of the diazonium salt compound may be used alone, or two or more kinds may be used together depending on the purposes, such as adjusting the hue, thereof.

Among the above-mentioned diazonium salt compounds, the diazonium salt compounds represented by the following structural formulae (1) to (3) are more preferable from the viewpoint of the hue of pigments, the image preserving property and the image fixing property.

Structural formula (1)

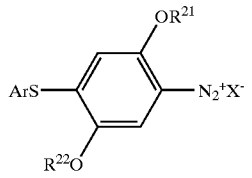

in which Ar represents an aryl groups that is substituted or unsubstituted.

Examples of the substituent include: alkyl groups, alkoxy groups, alkylthio groups, aryl groups, aryloxy groups, arylthio groups, acyl groups, alkoxycarbonyl groups, carbamoyl groups, carboamide groups, sulfonyl groups, sulfamoyl groups, sulfone amid groups, ureide groups, halogen groups, amino groups and heterocyclic groups; these may be further substituted.

Preferable examples of the aryl groups represented by Ar include aryl groups having 6 to 30 carbon atoms, specifically phenyl groups, 2-methylphenyl groups, 2-chlorophenyl groups, 2-methoxyphenyl groups, 2-butoxyphenyl groups, 2-(2-ethylhexyloxy)phenyl groups, 2-octyloxyphenyl groups, 3-(2,4-di-t-pentylphenoxyethoxy)phenyl groups, 4-chlorophenyl groups, 2,5-dichlorophenyl groups, 2,4,6-trimethylphenyl groups, 3-chlorophenyl groups, 3-methylphenyl groups, 3-methoxyphenyl groups, 3-butoxyphenyl groups, 3-cyanophenyl groups, 3-(2-ethylhexyloxy)phenyl groups, 3,4-dichlorophenyl groups, 3,5-dichlorophenyl groups, 3,4-dimethoxyphenyl groups, 3-(dibutylaminocarbonylmethoxy)phenyl groups, 4-cyanophenyl groups, 4-methylphenyl groups, 4-methoxyphenyl groups, 4-butoxyphenyl groups, 4-(2-ethylhexyloxy)phenyl groups, 4-benzylphenyl groups, 4-aminosulfonylphenyl groups, 4-N,N-dibutylaminosulfonylphenyl groups, 4-ethoxycarbonylphenyl groups, 4-(2-ethylhexylcarbonyl) phenyl groups, 4-fluorophenyl groups, 3-acetylphenyl groups, 2-acetylaminophenyl groups, 4-(4-chlorophenylthio)phenyl groups, 4-(4-methylphenyl)thio-2,5-butoxyphenyl groups, and 4-(N-benzyl-N-methylamino)-2-dodecyloxycarbonylphenyl groups. However, the aryl groups are not limited to these examples.

Moreover, each of these groups may be further substituted by alkyloxy groups, alkylthio groups, substituted phenyl groups, cyano groups, substituted amino groups, halogen atoms, heterocyclic groups, or the like.

In the structural formula (1), each of $R^{21}$ and $R^{22}$ independently represents a substituted or unsubstituted alkyl group or a substituted or unsubstituted aryl group. $R^{21}$ and $R^{22}$ may be the same or different from each other.

When $R^{21}$ or $R^{22}$ is substituted, examples of the substituent include alkoxy groups, alkoxycarbonyl groups, alkylsulfonyl groups, substituted amino groups, substituted amide groups, aryl groups and aryloxy groups. However, the substituents are not limited to these examples.

As the alkyl group represented by $R^{21}$ and $R^{22}$, alkyl groups having 1 to 18 carbon atoms are preferable, for example, methyl groups, trifluoromethyl groups, ethyl groups, propyl groups, isopropyl groups, butyl groups, sec-butyl groups, tert-butyl groups, pentyl groups, isopentyl groups, cyclopentyl groups, hexyl groups, cyclohexyl groups, octyl groups, tert-octyl groups, 2-ethylhexyl groups, nonyl groups, octadecyl groups, benzyl groups, 4-methoxybenzyl groups, tolphenylmethyl groups, ethoxycarbonylmethyl groups, butoxycarbonylmethyl groups, 2-ethylhexyloxycarbonylmethyl groups, 2',4'-diisopentylphenyloxymethyl groups, 2',4'-di-tert-butylphenyloxymethyl groups, dibenzylaminocarbonylmethyl groups, 2,4-di-tert-amylphenyloxypropyl groups, ethoxycarbonylpropyl groups, 1-(2',4'-di-tert-amylphenyloxy)propyl groups, acetylaminoethyl groups, 2-(N,N-dimethylamino)ethyl groups, 2-(N,N-diethylamino)propyl groups, methanesulfonylaminopropyl groups, acetylaminoethyl groups, 2-(N,N-dimethylamino)ethyl groups, and 2-(N,N-diethylamino)propyl groups.

As the aryl group represented by $R^{21}$ and $R^{22}$, aryl groups having 6 to 30 carbon atoms are preferable, and examples thereof include, but not limited to, phenyl groups, 2-methylphenyl groups, 2-chlorophenyl groups, 2-methoxyphenyl groups, 2-butoxyphenyl groups, 2-(2-ethylhexyloxy)phenyl groups, 2-octyloxyphenyl groups, 3-(2,4-di-t-pentylphenoxyethoxy)phenyl groups, 4-chlorophenyl groups, 2,5-dichlorophenyl groups, 2,4,6-trimethylphenyl groups, 3-chlorophenyl groups, 3-methylphenyl groups, 3-methoxyphenyl groups, 3-butoxyphenyl groups, 3-cyanophenyl groups, 3-(2-ethylhexyloxy)phenyl groups, 3,4-dichlorophenyl groups, 3,5-dichlorophenyl groups, 3,4-dimethoxyphenyl groups, 3-(dibutylaminocarbonylmethoxy)phenyl groups, 4-cyanophenyl groups, 4-methylphenyl groups, 4-methoxyphenyl groups, 4-butoxyphenyl groups, 4-(2-ethylhexyloxy)phenyl groups, 4-benzylphenyl groups, 4-aminosulfonylphenyl groups, 4-N,N-dibutylaminosulfonylphenyl groups, 4-ethoxycarbonylphenyl groups, 4-(2-ethylhexylcarbonyl)phenyl groups, 4-fluorophenyl groups, 3-acetylphenyl groups, 2-acetylaminophenyl groups, 4-(4-chlorophenylthio)phenyl groups, 4-(4-methylphenyl)thio-2,5-butoxyphenyl groups, and 4-(N-benzyl-N-methylamino)-2-dodecyloxycarbonylphenyl groups.

Moreover, these groups may be further substituted by alkyloxy groups, alkylthio groups, substituted phenyl groups, cyano groups, substituted amino groups, halogen atoms, heterocyclic groups or the like.

Structural formula (2)

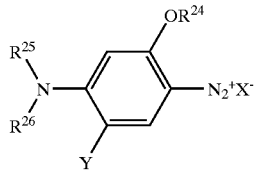

In the above-mentioned structural formula (2), each of $R^{24}$, $R^{25}$ and $R^{26}$ independently represents a substituted or unsubstituted alkyl group or a substituted or unsubstituted aryl group. $R^{24}$, $R^{25}$ and $R^{26}$ may be the same or different.

Examples of the substituent, when these groups are substituted, include: alkyl groups, alkoxy groups, alkylthio groups, aryl groups, aryloxy groups, arylthio groups, acyl groups, alkoxycarbonyl groups, carbamoyl groups, carboamide groups, sulfonyl groups, sulfamoyl groups, sulfone amid groups, ureide groups, halogen atoms, amino groups, heterocyclic groups.

As the alkyl groups represented by $R^{24}$, $R^{25}$ and $R^{26}$, alkyl groups having 1 to 18 carbon atoms are preferable, and examples thereof include alkyl groups represented by $R^{21}$ and $R^{22}$ in the above-mentioned structural formula (1), and 1-methyl-2-(4-methoxyphenoxy)ethyl groups, di-n-butylaminocarbonylmethyl groups, di-n-octylamino carbonylmethyl groups.

As the aryl groups represented by $R^{24}$, $R^{25}$ and $R^{26}$ may be the same as the aryl groups represented by $R^{21}$ and $R^{22}$ in the above-mentioned structural formula (1). However, $R^{24}$, $R^{25}$ and $R^{26}$ are not limited thereto.

Moreover, each of these groups may be further substituted by an alkyloxy groups, alkylthio groups, substituted phenyl groups, cyano groups, substituted amino groups, halogen atoms, heterocyclic groups, or the like.

In the structural formula (2), Y represents a hydrogen atom, or an $OR^{23}$ group, and the $R^{23}$ group represents a substituted or unsubstituted alkyl groups or a substituted or unsubstituted aryl groups.

When these groups are substituted, examples of the substituted group include: alkyl groups, alkoxy groups, alkylthio groups, aryl groups, aryloxy groups, arylthio groups, acyl groups, alkoxycarbonyl groups, carbamoyl groups, carboamide groups, sulfonyl groups, sulfamoyl groups, sulfone amid groups, ureide groups, halogen atoms, an amino groups, heterocyclic groups.

Among these groups and atoms represented by Y, from the viewpoint of adjusting the hue, hydrogen atoms and alkyloxy groups in which $R^{23}$ is an alkyl group are preferable.

The alkyl group represented by $R^{23}$ is equivalent to the alkyl groups represented by $R^{21}$ and $R^{22}$ in the structural formula (1), but not limited thereto.

The aryl group represented by $R^{23}$ is equivalent, but not limited, to the aryl groups represented by $R^{21}$ and $R^{22}$ in the above-mentioned structural formula (1). These aryl groups may be further substituted by an alkyloxy groups, akylthio groups, substituted phenyl groups, cyano groups, substituted amino groups, halogen atoms, heterocyclic groups, or the like.

Structural formula (3)

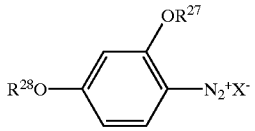

In the above-mentioned structural formula (3), each of $R^{27}$ and $R^{28}$ independently represents a substituted or unsubstituted alkyl groups or a substituted or unsubstituted aryl groups. $R^{27}$ and $R^{28}$ may be the same or different from each other.

When $R^{27}$ and $R^{28}$ are substituted, examples of the substituent include: alkyl groups, alkoxy groups, alkylthio groups, aryl groups, aryloxy groups, arylthio groups, acyl groups, alkoxycarbonyl groups, carbamoyl groups, carboamide groups, sulfonyl groups, sulfamoyl groups, sulfone amid groups, ureide groups, halogen atoms, amino groups, heterocyclic groups.

The alkyl groups represented by $R^{27}$ and $R^{28}$ are equivalent to the alkyl groups represented by $R^{21}$ and $R^{22}$ in the structural formula (1); however, the alkyl groups are not limited thereto.

The aryl groups represented by $R^{27}$ and $R^{28}$ are equivalent to the aryl groups represented by $R^{21}$ and $R^{22}$ in the structural formula (1); however, they are not limited thereto. These aryl groups may be further substituted by alkyloxy groups, alkylthio groups, substituted phenyl groups, cyano groups, substituted amino groups, halogen atoms, heterocyclic groups, or the like.

In the structural formulae (1) to (3), $X^-$ represents an acidic anion. Examples of the acidic anion include polyfluoroalkylcarboxylic acids having 1 to 9 carbon atoms, polyfluoroalkylsulfonic acids having 1 to 9 carbon atoms, boron tetrafluorides, tetraphenylborons, hexafluorophosphoric acids, aromatic carboxylic acids and aromatic sulfonic acids. Among these, from the viewpoint of crystalline, hexafluorophosphoric acid is preferable.

The following description will show specific examples of diazonium salt compounds represented by the structural formulae (1) to (3); however, the present invention is not limited to these examples.

(2)-1

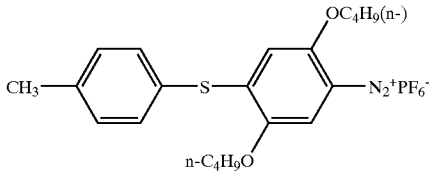

(2)-2

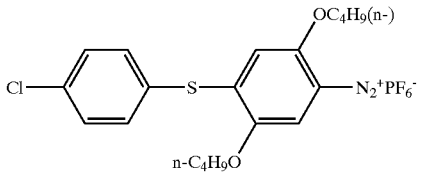

(2)-3

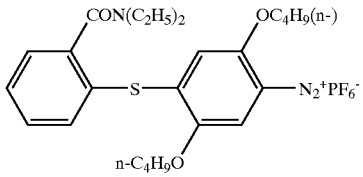

(2)-4

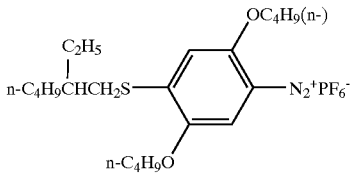

(2)-5

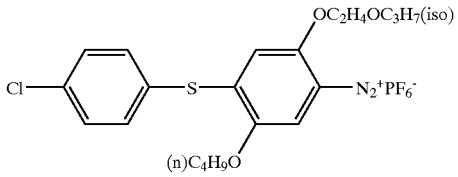

(3)-1

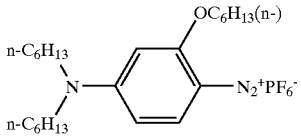

(3)-2

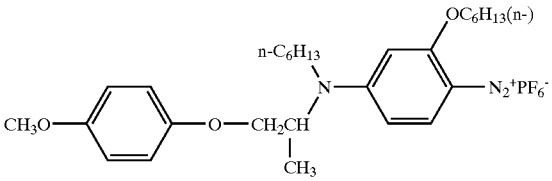

-continued (3)-3

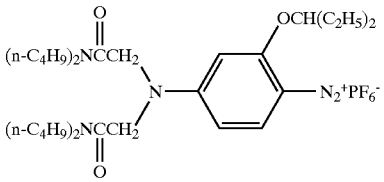

(3)-4

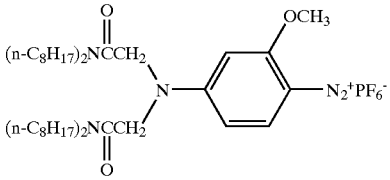

(3)-5

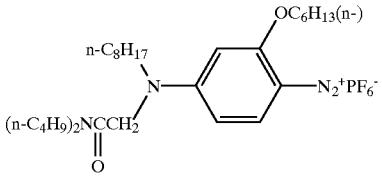

(3)-6

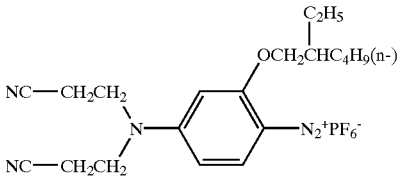

(3)-7

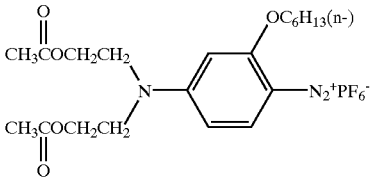

(3)-8

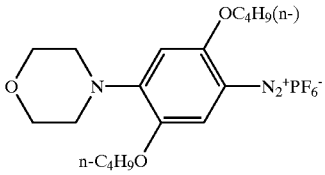

(3)-9

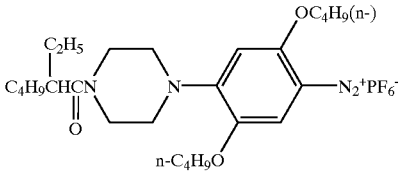

(3)-10

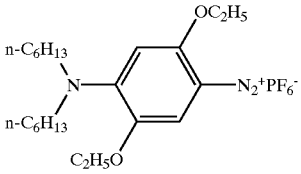

-continued (4)-1

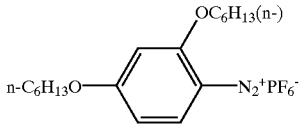

The diazonium salt compounds represented by the structural formulae (1) to (3), may be used alone, or two or more these may be used in combination. Moreover, each of the diazonium salt compounds represented by the structural formulae (1) to (3) may be used in combination with another known diazonium salt compound, depending on various purposes such as adjusting the hue.

The coated amount of the diazonium salt compound in the thermal recording layer is preferably 0.05 to 2 g/m$^2$ and more preferably, 0.1 to 1 g/m$^2$. If the content is less than 0.05 g/m$^2$ , a sufficient coloring density might not be obtained. If the content exceeds 2 g/m$^2$, the coating property of the coating solution might become inferior.

(Coupler)

As the coupler which is coupled with the above-mentioned diazonium salt compound to form a pigment and consequently to develop a color, any compound may be used as long as it has a coupling reaction with a diazonium salt compound under a basic atmosphere and/or a neutral atmosphere to form a pigment.

All of so-called 4 equivalent couplers, which are used in silver halide photosensitive materials, may be used as couplers, and these may be appropriately selected in accordance with the objectives, such as adjusting the hue.

For example, so-called active methylene compounds, phenol derivatives, and naphthol derivatives, which have a methylene group next to a carbonyl group.

Among these, compounds represented by the following general formula (2) or compatible isomers of the compound are particularly preferable.

$$E^1—CH_2—E^2 \quad (2)$$

in which $E^1$ and $E^2$ each independently represents electron-attracting groups, and may be the same or different from each other.

The above-mentioned electron-attracting groups refers to a substituent having a positive Hammett σ value, and preferable examples thereof include: acyl groups such as acetyl groups, propionyl groups, pivaloyl groups, chloroacetyl groups, trichloroacetyl groups, trifluoroacetyl groups, 1-methylcyclopropylcarbonyl groups, 1-ethylcyclopropylcarbonyl groups, 1-benzylcyclopropylcarbonyl groups, benzoyl groups, 4-methoxybenzoyl groups, tenoyl groups and the like; alkoxy carbonyl groups such as methoxycarbonyl groups, aethoxycarbonyl groups, 2-methoxyethoxycarbonyl groups, 4-methoxyphenoxycarbonyl groups and the like; carbamoyl groups such as carbamoyl groups, N,N-dimethylcarbamoyl groups, N,N-diethylcarbamoyl groups, N,N-dimethylcarbamoyl groups, N,N-diethylcarbamoyl groups, N-phenylcarbamoyl groups, N-[2,4-bis(pentyloxy)phenyl] carbamoyl groups, N-[2,4-bis(octyloxy)phenyl] carbamoyl groups, morpholinocarbonyl groups and the like; alkylsulfonyl groups or arylsulfonyl groups such as methanesulfonyl groups, benzenesulfonyl groups, toluenesulfonyl groups and the like; phosphono groups such as diethylphosphono groups and the like; heterocyclic groups such as benzoxazol-2-il groups, benzothiazole-2-il groups, 3,4-dihydroquinazoline-4-on-2-il groups, 3,4 dihydroquinazoline-4-sulfone-2-il groups and the like; nitro groups, imino groups and cyano groups.

Moreover, $E^1$ and $E^2$ may be bonded each other to form a ring. For the ring formed by $E^1$ and $E^2$, a carbon ring or a heterocyclic ring having 5 members or 6 members is preferable.

Specific examples of the above-mentioned coupler include: resorcins, phloroglucins, 2,3-dihydroxynaphthalenes, sodium 2,3-dihydroxynaphthalene-6-sulfonates, 1-hydroxy-2-naphthoic morpholinopropylamides, sodium 2-hydroxy-3-naphthalenesulfonates, 2-hydroxy-3-naphthalenesulfonic anilides, 2-hydroxy-3-naphthalenesolfonic morpholinopropylamides, 2-hydroxy-3-naphthalenesulfonate-2-ethylhexyloxypropylamides, 2-hydroxy-3-naphthalenesulfonate-2-ethylhexylamides, 5-acetamide-1-naphthols, sodium 1-hydroxy-8-acetamidenaphthalene-3,6-disulfonates, 1-hydroxy-8-acetamidenaphthalene-3,6-disulfonic dianilides, 1,5-dihydroxynaphthalenes, 2-hydroxy-3-naphthoic morpholinopropylamides, 2-hydroxy-3-naphthoic octylamides, 2-hydroxy-3-naphthoic anilides, 5,5-dimethyl-1,3-cyclohex anedions, 1,3-cyclopentanedions, 5-(2-n-tetradecyloxyphenyl)-1,3-cyclohexanedions, 5-phenyl-4-methoxycarbonyl-1,3-cyclohexanedions, 5-(2,5-di-n-octyloxyphenyl)-1,3-cyclohexanedions, -N,N'-dicyclohexyl barbituric acids, N,N'-di-n-dodecyl barbituric acids, N-n-octyl-N'-n-octadecyl barbituric acids, N-phenyl-N'-(2,5-di-n-octyloxyphenyl)barbituric acids, N,N'-bis (octadecyloxycarbonylmethyl)barbituric acids. 1-phenyl-3-methyl-5-pyrazolone, 1-(2,4,6-trichlorophenyl)-3-anilino-5-pyrazolones, 1-(2,4,6-trichlorophenyl)-3-benzamide-5-pyrazolones, 6-hydroxy-4-methyl-3-cyano-1-(2-ethylhexyl)-2-pyridones, 2,4-bis-(benzoylacetamide) toluenes, 1,3-bis-(pivaloylacetamidemethyl)benzenes, benzoylacetonitriles, thenoylacetonitriles, acetoacetoanilides, benzoylacetoanilides, pivaloylacetoanilides, 2-chloro-5-(N-n-butylsulfamoyl)-1-pivaloylacetamidebenzenes, 1-(2-ethylhexyloxypropyl)-3-cyano-4-methyl-6-hydroxy-1,2-dihydropyridine-2-ons, 1-(dodecyloxypropyl)-3-acetyl-4-methyl-6-hydroxy-1,2-dihydropyridine-2-ons, and 1-(4-n-octyloxyphenyl)-3-tert-butyl-5-aminopyrazoles.

A detailed description of the above-mentioned coupler is disclosed in JP-A Nos. 4-201483, 7-223367, 7-223368 and 7-323660, Japanese Patent Application Nos. 5-278608, 5-297024, 6-18669, 6-18670, 7-316280, 8-027095, 8-027096, 8-030799, 8-12610, 8-132394, 8-358755, 8-358756 and 9-069990.

The following description will show specific examples of the coupler represented by the general formula (2); however, the invention is not limited to these examples.

B-1

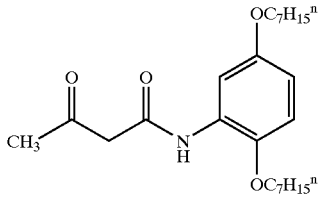

-continued
B-2
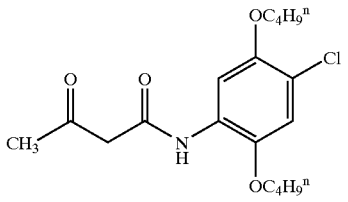
B-3
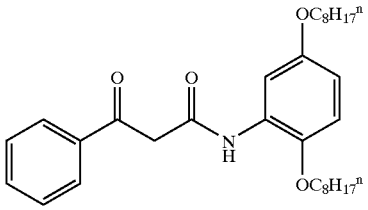
B-4
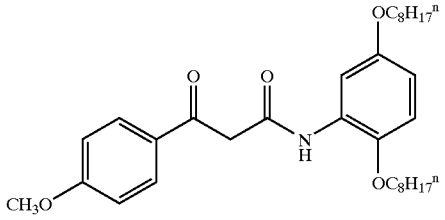
B-5
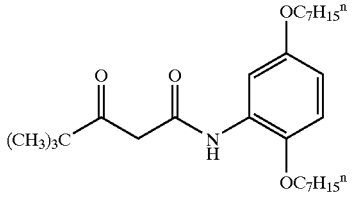
B-6
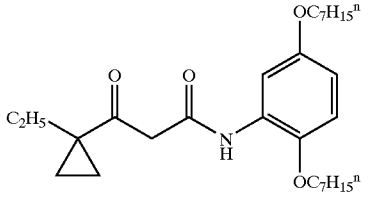
B-7
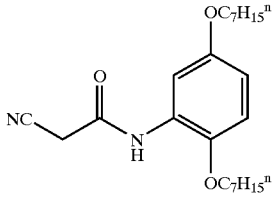
B-8
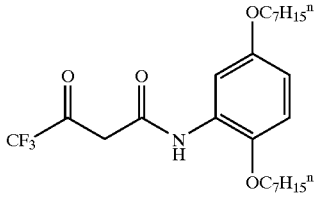
-continued
B-9
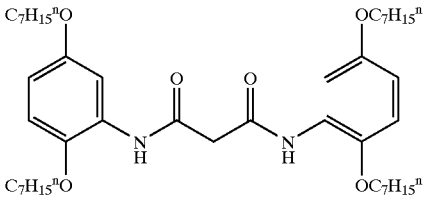
B-10
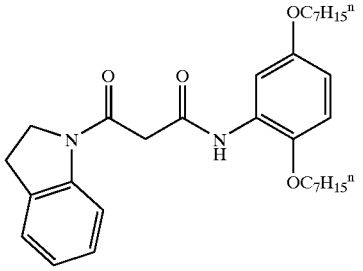
B-11
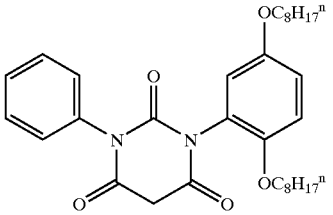
B-12
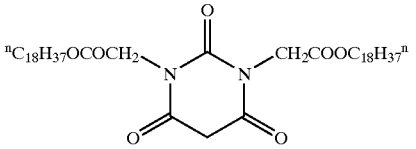
B-13
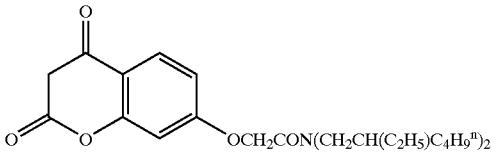
B-14
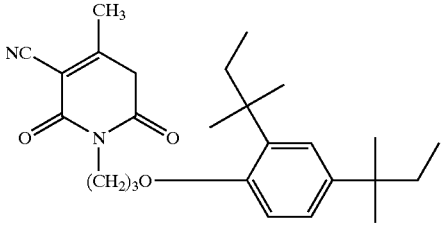
B-15
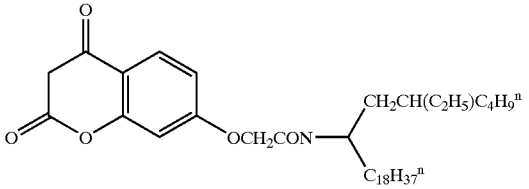

-continued
B-16
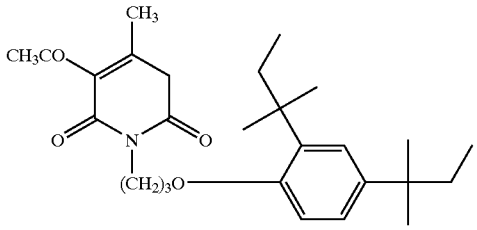
B-17
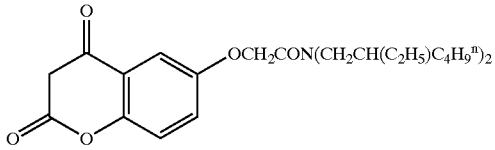
B-18
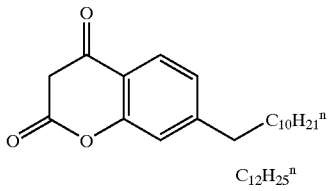
B-19
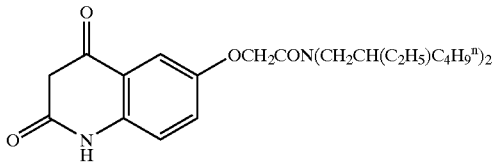
B-20
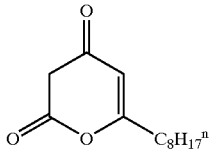
B-21
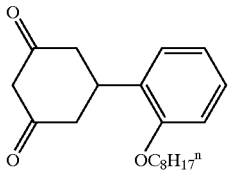
B-22
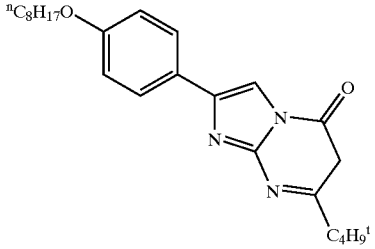
-continued
B-23
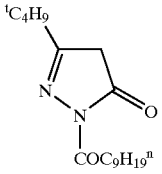
B-24
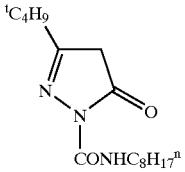
B-25
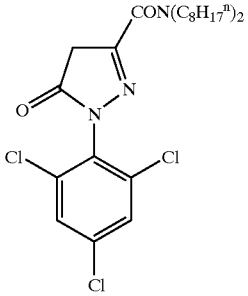
B-26
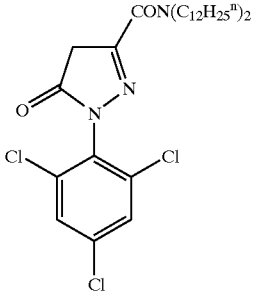
B-27
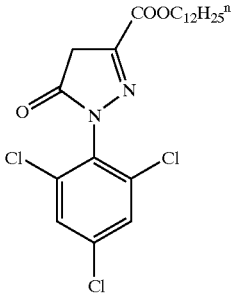
B-28
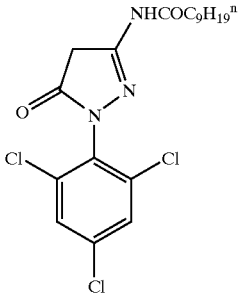

-continued

B-29

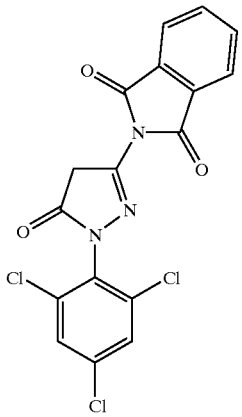

B-30

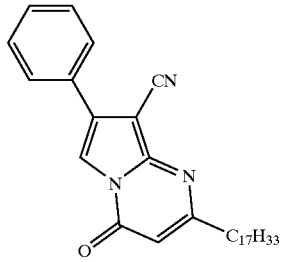

The content of the coupler in the thermal recording layer is preferably 0.1 to 30 parts by mass relative to 1 part by mass of the diazonium salt compound.

In the heat-sensitive recording material of the present invention, in addition to the diazonium salt compound and coupler (diazo-based coloring agent), a combination of an electron-supplying dye precursor and an electron-receiving compound (leuco-based coloring agents) may be used as coloring components. For example, in a heat-sensitive recording material having a plurality of thermal recording layers on a substrate, at least one layer may a leuco-based coloring agent.

As the electron-supplying dye precursor, examples thereof include triaryl methane-based compounds, diphenyl methane-based compounds, thiazine-based compounds, xanthene-based compounds and spiropyrane-based compounds. Among these examples, triaryl methane-based compounds and xanthene-based compounds are preferable because of their high coloring density.

Specific examples include: 3,3-bis(p-dimethylaminophenyl)-6-dimethylaminophthalides (that is, crystal violet lactones), 3,3-bis(p-dimethylamino) phthalides, 3-(p-dimethylaminophenyl)-3-(1,3-dimethylindole-3-il)phthalides, 3-(p-dimethylaminophenyl)-3-(2-methylindole-3-il)phthalides, 3-(o-methyl-p-diethylaminophenyl)-3-(2-methylindole-3-il) phthalides, 4,4'-bis(dimethylamino) benzhydrinbenzylethers, N-halophenylleuco auramines, N-2,4,5-trichlorophenylleuco auramines, rhodamine-B-anilinolactams, rhodamine(p-nitroanilino)lactams, rhodamine-B-(p-chloroanilino)lactams, 2-benzylamino-6-diethylaminofluorans, 2-anilino-6-diethylaminofluorans, 2-anilino-3-methyl-6-diethylaminofluorans, 2-anilino-3-methyl-6-cyclohexylmethylaminofluorans, 2-anilino-3-methyl-6-isoamylethylaminofluorans, 2-(o-chloroanilino)-6-diethylaminofluorans, 2-octylamino-6-diethylaminofluorans, 2-octylamino-6-diethylaminofluorans, 2-ethoxyethylamino-3-chloro-2-diethylaminofluorans, 2-anilino-3-chloro-6-diethylaminofluorans, benzoylleuco methylene blues, p-nitrobenzylleuco methylene blues, 3-methyl-spiro-dinaphthopyrans, 3-ethyl-spiro-dinaphthopyrans, 3,3'-dichloro-spiro-dinaphthopyrans, 3-benzylspirodinaphthopyrans, and 3-propyl-spiro-dibenzopyrans.

The coated amount of the electron-supplying dye precursor is preferably 0.1 to 1 g/m2 for the same reasons as for the aforementioned diazonium salt compound.

Examples of the above-mentioned electron-receiving compound include phenol derivatives, salicylic acid derivatives and hydroxybenzoates, and in particular, bisphenols and hydroxybenzoates are preferable. More specific examples include: 2,2-bis(p-hydroxyphenyl)propanes, (that is, bisphenol A), 4,4'-(p-phenylenediisopropylidene) diphenols, (that is, bisphenol P), 2,2-bis(p-hydroxyphenyl) pentanes, 2,2-bis(p-hydroxyphenyl)ethanes, 2,2-bis(p-hydroxyphenyl)butanes, 2,2-bis(4'-hydroxy-3',5'-dichlorophenyl)propanes, 1,1-(p-hydroxyphenyl) cyclohexanes, 1,1-(p-hydroxyphenyl)propanes, 1,1-(p-hydroxyphenyl)pentanes, 1,1-(p-hydroxyphenyl)-2-ethylhexanes, 3,5-di(α-methylbenzyl)salicylic acids and polyvalent metal salts thereof, 3,5-di(tert-butyl)salicylic acids and polyvalent metal salts thereof, 3-α,α-dimethylbenzylsalicylic acids and polyvalent metal salts thereof, butyl p-hydroxybenzoic acids, benzyl p-hydroxybenzoic acids, p-hydroxybenzoate-2-ethylhexyls, p-phenylphenols and p-cumylphenols.

An amount of the electron-receiving compound in the thermal recording layer is preferably 0.1 to 30 parts by mass relative to 1 part by mass of the electron-supplying dye precursor.

(Other Components)

Organic Base

In the present invention, in order to accelerate the coupling reaction between the diazonium salt and the coupler, it is preferable to add an organic base.

The organic base is preferably included in the photosensitive thermal recording layer together with the diazonium salt and the coupler, and one, or two or more kinds of the organic base may be used.

Examples of the organic base include nitrogen-containing compounds such as tertiary amines, piperidines, piperazines, amidines, formamidines, pyridines, guanidines and morpholines. Organic bases disclosed in the following patent specifications may also be used: Japanese Patent Application Publication (JP-B) Nos. 52-46806, 2-24916, and 2-28479 JP-A Nos. 62-70082, 57-169745, 60-94381, 57-123086, 58-1347901, 60-49991, 60-165288, and 57-185430.

Among these, preferable examples include: piperazines such as N,N'-bis(3-phenoxy-2-hydroxypropyl)piperazines, N,N'-bis[3-(p-methylphenoxy)-2-hydroxypropyl] piperazines, N,N'-bis[3-(p-methoxyphenoxy)-2-hydroxypropyl]piperazines, N,N'-bis(3-phenylthio-2-hydroxypropyl)piperazines, N,N'-bis[3-(β-naphthoxy)-2-hydroxypropyl]piperazines, N-3-(β-naphthoxy)-2-hydroxypropyl-N'-methylpiperazines, 1,4-bis{[3-(N-methylpiperazino)-2-hydroxy]propyloxy}benzenes, morpholines such as N-[3-(β-naphthoxy)-2-hydroxy] propylmorpholines, 1,4-bis(3-morpholino-2-hydroxypropyloxy)benzenes and 1,3-bis(3-morpholino-2-hydroxypropyloxy)benzenes, piperidines such as N-(3-phenoxy-2-hydroxypropyl)piperidines and N-dodecylpiperidines, and guanidines such as triphenylguanidines, tricyclohexylguanidines and dicyclohexylphenylguanidines.

When an organic base is contained as desired in the thermal recording layer the content of the organic base is preferably 0.1 to 30 parts by mass relative to 1 part by mass of the diazonium salt compound.

Intensifier

In addition to the organic base, an intensifier may be added to the thermal recording layer in order to accelerate the coloring reaction.

The intensifier is a substance which increases the coloring density at the time of recording process by heat, or reduces the minimum coloring temperature. The intensifier allows the diazonium salt, organic base, coupler and the like to readily react with each other because it can lower the melting point of the coupler, organic base, and diazonium salt or the softening point of the capsule wall.

Specifically, a low-melting-point organic compound which has an aromatic groups and a polarity groups in a molecule appropriately is preferable; examples thereof include: benzyl p-benzyloxy benzoates, α-naphthylbenzylethers, β-naphthylbenzylethers, β-naphthoic phenylesters, α-hydroxy-β-naphthoic phenylesters, β-naphthol-(p-chlorobenzyl)ethers, 1,4-butanediolphenylethers, 1,4-butanediolphenyl-p-methylphenylethers, 1,4-butanediol-p-ethylphenylethers, 1,4-butanediolphenyl-m-methylphenylethers, 1-phenoxy-2-(p-tolyloxy)ethanes, 1-phenoxy-2-(p-ethylphenoxy)ethanes, 1-phenoxy-2-(p-chlorophenoxy)ethanes and p-benzylbiphenyls.

Binder

As a binder used for the thermal recording layer, known water-soluble polymer compounds and latexes are listed.

Examples of the water-soluble polymer compounds include: methylcelluloses, carboxymethylcelluloses, hydroxyethylcelluloses, hydroxypropylcelluloses, starch derivatives, caseins, Arabic rubbers, gelatins, ethylene-maleic anhydride copolymers, styrene-maleic anhydride copolymers, polyvinyl alcohols, epichlorohydrin denatured polyamides, isobutylene-maleic salicylic acid anhydride copolymers, polyacrylic acids, polyacrylic amides, and denatured substances thereof. Examples of the latexes include styrene-butadiene rubber latexes, methylacrylate-butadiene rubber latexes and vinyl acetate emulsions.

Antioxidant and the Like

Moreover, in order to improve the durability of a color-developed image to light and heat and to reduce yellowing on unprinted portions (non-image portions) due to light after fixing process, the following known antioxidants are preferable.

Examples of these antioxidants are listed in the following patent specifications: EP Nos. 223739, 309401, 309402, 310551, 310552 and 459416, German Patent Applications No. 3435443, JP-A Nos. 54-48535, 62-262047, 63-113536, 63-163351, 2-262654, 2-71262, 3-121449, 5-61166 and 5-119449, U.S. Pat. Nos. 4,814,262, and 4,980,275.

In the present invention, forms in which other components such as a coupler, an organic base and an intensifier are used are not particularly limited. For example, the following methods are listed: (1) a method which the solid substance is dispersed and used (2) a method which the material is emulsified dispersed and used (3) a method which the material is polymer-dispersed and used (4) a method which the material is latex-dispersed and used, and (5) a method which the material is encapsulated in microcapsules and used.

(Manufacturing Method of a Microcapsule Solution)

The microcapsules contained in the microcapsule solution of the present invention encapsulate the diazonium salt (and electron-supplying dye precursor) and the aromatic carboxylates represented by formulae (I) and (II), to improve the storage stability of the microcapsule solution and the storage stability of the heat-sensitive recording material, and in particular, to improve the shelf life of the whiteness on base surface portions. Moreover, as already described in the present invention, it is preferable to also encapsulate the aforementioned thermal acid-generating agent in the microcapsules.

For a method for forming the coloring components into microcapsules, conventionally known methods may be used. For example, a preferable method is an interface polymerization method in which: an oil phase, which has been prepared by dissolving or dispersing the diazonium salt compound (and the electron-supplying dye precursor) serving as one of the coloring components into an organic solvent that is hardly soluble or insoluble in water together with the aromatic carboxylates represented by formulae (I) and (II) and the thermal acid-generating agent, is mixed with an aqueous phase in which a water-soluble polymer has been dissolved, and after having been emulsion dispersed by a device, such as a homogenizer, and subsequently heated, a polymer forming reaction takes place on the interface of oil droplets to form microcapsule walls of polymer substance. Using this interface polymerization method, it is possible to form capsules having a uniform particle size in a short time, and consequently to obtain a recording material that has a superior in the shelf life.

Examples of the organic solvent include: low boiling-point assistant solvents such as acetates, methylene chlorides and cyclohexanes, and/or carboxylates such as phosphates, phthalates, acrylates and methacrylates, fatty acid esters, alkylated biphenyls alkylated terphenyls, alkylated naphthalene, diaryl ethanes, chlorinated paraffins, alcohol-based solvents, phenol-based solvents, ether-based solvents, mono-olefin-based solvents and epoxy-based solvents.

Specific examples include: high boiling-point solvents such as tricresyl phosphates, trioctyl phosphates, octyldiphenyl phosphates, tricyclohexyl phosphates, dibutyl phthalates, dioctyl phthalates, dilaurylate phthalates, dicyclohexyl phthalates, butyl olefin acids, diethyleneglycol benzoates, dioctyl sebacic acids, dibutyl sebacic acids, dioctyl adipic acids, trioctyl trimellitic acids, acetyltriethyl citrates, octyl maleates, dibutyl maleates, isoamyl biphenyls, chlorinated paraffins, diisopropyl naphthalenes, 1,1'-ditolylethanes, monoisopropylbiphenyls, diisopropylbiphenyls, 2,4-ditertiaryamylphenols, N,N-dibutyl-2-butoxy-5-tertiaryoctylanilines, hydroxybenzoic 2-ethylhexyl esters and polyethylene glycols.

Among these examples, alcohol-based solvents, phosphate-based solvents, carboxylate-based solvents, alkylated biphenyl, alkylated terphenyl, alkylated naphthalene and diaryl ethane are particularly preferable.

Moreover, an anti-carbonization agent, such as hindered phenols or hindered amines, may be added to the above-mentioned high boiling-point solvent. Furthermore, as the high boiling-point solvent, those having an unsaturated fatty acid are particularly preferable, for example, α-methylstyrene dimmers. "MSD100", made by Mitsui Toatsu Kagaku K. K., may be used as the α-methylstyrene dimer, for example,.

Examples of the above-mentioned water-soluble polymers include water-soluble polymers, such as polyvinyl alcohol, and examples thereof include: polyvinyl alcohols, silanol denatured polyvinyl alcohols, carboxy denatured polyvinyl alcohols, amino denatured polyvinyl alcohols, itaconic acid denatured polyvinyl alcohols, styrene-maleic anhydride copolymers, butadiene-maleic anhydride copolymers, ethylene-maleic anhydride copolymers, isobutylene-maleic anhydride copolymers, polyacrylamides, polystyrene sulfonic acids, polyvinyl pyrrolidones, ethylene-acrylic acid copolymer and gelatins. Among these, carboxy denatured polyvinyl alcohols are preferable.

Latexes or emulsions of a hydrophobic polymer may be used in combination with the water-soluble polymer. Examples of the emulsions and the latexes include styrene-butadiene copolymers, carboxy denatured styrene-butadiene copolymers and acrylonitrile-butadiene copolymers. If necessary, a known surfactant and the like may be added thereto.

Examples of the polymer substance forming the microcapsule wall include: polyurethane resins, polyurea resins, polyamide resins, polyester resins, polycarbonate resins, aminoaldehyde resins, melamine resins, polystyrene resins, styrene-acrylate copolymer resins, styrene-methacrylate copolymer resins, gelatins and polyvinyl alcohols. Among these, polyurethane resins and polyurea resins are more preferable.

For example, when a polyurethane resin or a polyurea resin is used as the capsule wall material, a microcapsule wall precursor such as polyhydric isocyanate is formed into capsules and is mixed into oil solvent (oil phase) which will be used as a core material. A second substance (for example, a polyol or a polyamine), which reacts with the microcapsule precursor to form capsule walls, is mixed into a water-soluble polymer water solution (water phase). After the oil phase has been emulsified, dispersed into the water phase and subsequently heated, a polymer forming reaction takes place on the interface of oil droplets to form the microcapsule walls.

The following description will show specific examples of the polyhydric isocyanate compounds, which are not limited to these examples: diisocyanates such as m-phenylenediisocyanates, p-phenylenediisocyanates, 2,6-tolylenediisocyanates, 2,4-tolylenediisocyanates, naphthalene-1,4-diisocyanates, diphenylmethane-4,4'-diisocyanates, 3,3'-diphenylmethane-4,4'-diisocyanates, xylene-1,4-diisocyanates, 4,4'-diphenylpropanediisocyanates, trimethylenediisocyanates, hexamethylenediisocyanates, propylene-1,2-diisocyanates, butylenes-1,2-diisocyanates, cyclohexylene-1,2-diisocyanates and cyclohexylene-1,4-diisocyanates, triisocyanates such as 4,4',4"-triphenylmethanetriisocyanates and toluene-2,4,6-triisocyanates, tetraisocyanates such as 4,4'-dimethylphenylmethane-2,2',5,5'-tetraisocyanates, and isocyanate prepolymers such as adducts of hexamethylenediisocyanates and trimethylolpropanes, adducts of 2,4-tolylenediisocyanates and trimethylolpropanes, adducts of xylenediisocyanates and trimethylolpropanes, and adducts of tolylenediisocyanates and hexanetriols.

Moreover, two or more of these examples may be used in combination. Among these examples, those having not less than three isocyanate groups in a molecular are more preferable.

In the microcapsules forming method, as an organic solvent that dissolves other components such as a coupler (and electron-receiving compound), an organic base and an intensifier, and the microcapsule wall precursor the second substance to react with this, the same organic solvents as described earlier are used.

The particle size of the microcapsules is preferably 0.1 to 2.0 $\mu$m, more preferably, 0.2 to 1.5 $\mu$m.

(Construction of Heat-sensitive Recording Material)

The following description will disclose a specific construction of a multi-color heat-sensitive recording material.

The heat-sensitive recording material of the present invention may be a mono-color heat-sensitive recording material having a single thermal recording layer on a support or a multi-color heat-sensitive recording material having a laminated thermal recording layer formed by laminating a plurality of mono-color recording layers. A preferable embodiment of the multi-color heat sensitive recording material comprises a structure, in which at least one of the layers forming the heat sensitive layer is a photo-fixing-type recording layer comprising a diazonium salt and a coupler that reacts with the diazonium salt to produce a color.

In particular, in the case of a full-color thermal recording layer containing cyan, yellow and magenta thermal recording layers, the heat-sensitive recording material preferably has an arrangement in which: all three layers on the substrate comprise diazo-color developing agents; or the first thermal recording layer closest to the substrate comprises a leuco-color developing agent containing an electron-supplying dye and an electron-receiving compound, the second and third thermal recording layers comprise diazo-color developing agents.

For example, the structures as shown in the following (a) to (c) may be used:

(a) A recording layer, which is formed by laminating the following layers on a substrate in this order: a photo-fixing-type recording layer (first recording layer (A layer)) containing a diazonium salt compound having the maximum absorbency wavelength of 365±40 nm and a coupler that reacts with the diazonium salt compound to develop colors; a photo-fixing-type recording layer (second recording layer (B layer)) containing a diazonium salt compound having the maximum absorbency wavelength of 420±40 nm and a coupler that reacts with the diazonium salt compound to develop colors; on a substrate, and if necessary, a layer adjusting light-transmittance and a protective layer.

(b) A recording layer, which is formed by laminating the following layers on a substrate in this order: a recording layer (first recording layer (A layer)) containing an electron-supplying dye and an electron-receiving compound; a photo-fixing-type recording layer (second recording layer (B layer)) containing a diazonium salt compound having the maximum absorbency wavelength of 365±40 nm and a coupler that reacts with the diazonium salt compound to develop colors; a photo-fixing-type recording layer (third recording layer (C layer)) containing a diazonium salt compound having the maximum absorbency wavelength of 420±40 nm and a coupler that reacts with the diazonium salt compound to develop colors; and if necessary, a layer adjusting light-transmittance and a protective layer.

(c) A recording layer, which is formed by laminating the following layers on a substrate in this order: a photo-fixing type recording layer (first recording layer (A layer)) containing a diazonium salt compound having the maximum absorbency wavelength of not more than 350 nm and a coupler that reacts with the diazonium salt compound to develop colors; a photo-fixing-type recording layer (second recording layer (B layer)) containing a diazonium salt compound having the maximum absorbency wavelength of 365±40 nm and a coupler that reacts with the diazonium salt compound to develop colors; a photo-fixing-type recording layer (third recording layer (C layer)) containing a diazonium salt compound having the maximum absorbency wavelength of 420±40 nm and a coupler that reacts with the diazonium salt compound to develop colors; and if necessary, a layer adjusting light-transmittance and a protective layer.

Referring to the above-mentioned example (b) or (c), the following description will disclose a method of multi-color recording processes.

First, the third recording layer (C layer) is heated to react the diazonium salt with the coupler contained in the layer to develop color. Next, light, which has the light-emitting center wavelength of 430±30 nm, is irradiated on the C layer so that unreacted diazonium salt compound contained therein is decomposed, and photo-fixed. Then the layers are heated sufficiently so as to allow the second recording layer (B layer) to develop color and the diazonium salt compound is reacted with the coupler contained in the B layer to develop color. Although the C layer is also heated at this time, the diazonium salt compound therein has already been decomposed (photo-fixed) and the color-developing function has been lost; thus with no color is developed in the C layer. Moreover, light, which has the light-emitting center wavelength of 360±20 nm, is irradiated on the B layer so that diazonium salt compound contained therein is decomposed, and photo-fixed. Finally, the layers are heated sufficiently to allow the first recording layer (A layer) to develop color. Although the C layer and the B layer are also heated at this time, the diazonium salt compound therein has already been decomposed (photo-fixed) thus the color-developing function has been lost and no color develops.

Moreover, when all of the recording layers (A layer, B layer and C layer) are diazo-based recording layers, it is necessary to photo-fix the B layer and the C layer after they have developed colors; however, the photo-fixing process is not necessarily required for the A layer which is subjected to an image-recording process.

As a light source used for the photo-fixing, an appropriate one may be selected from known light sources. For example, various lamps, such as fluorescent lamps, xenon lamps and mercury lamps, may be used. Among these, it is preferable to use a light source whose light-emitting spectrum is substantially the same as the absorbing spectrum of the diazonium salt compound used in the recording material, from the viewpoint of light fixing process with high efficiency.

Other Layers

In the heat-sensitive recording material of the present invention, in addition to the one or more thermal recording layers that are placed on a substrate, a layer adjusting light-transmittance and a protective layer are preferably formed thereon.

(Layer Adjusting Light-transmittance)

The layer adjusting light-transmittance contains an ultraviolet-ray absorbent precursor, and since this precursor does not function as an ultraviolet-ray absorbent prior to light irradiation with wavelengths in a range required for fixing, it can provide a high light transmittance. Moreover, when the photo-fixing-type thermal recording layer is fixed, no problems are caused on the fixing process of the thermal recording layer because the light-transmittance adjusting layer allows the wavelengths required for fixing to pass sufficiently and also has a high transmittance of visible light rays. This ultraviolet-ray absorbent precursor is preferably encapsulated in the microcapsules.

Moreover, examples of compounds to be contained in the layer adjusting light-transmittance are listed in JP-A No. 9-1928.

The ultraviolet-ray absorbent precursor begins to function as an absorbent of ultraviolet-ray by reacting with light, heat or the like, after the completion of light irradiation with the wavelengths required for fixing of the thermal recording layer. The light having the wavelengths required for fixing in the ultraviolet-ray range is absorbed by the absorbent of ultraviolet-ray, thus the transmittance of the ultraviolet-ray becomes lower, therefore, the light resistant property of the heat-sensitive recording material improves. However, since there is no absorbing effects for visible light rays, the transmittance of the visible light rays has virtually no changes.

At least one layer adjusting light-transmittance may be formed in the heat-sensitive recording material. However, the layer adjusting light-transmittance is most preferably formed between the thermal recording layer and the outermost protective layer, and may also function as the protective layer. The properties of the layer adjusting light-transmittance may be freely selected in accordance with the properties of the thermal recording layer.

The coating solution used for forming the layer adjusting light-transmittance (coating solution for the layer adjusting light-transmittance) is obtained by mixing the above-mentioned respective components. The coating solution for the layer adjusting light-transmittance can be coated by a known coating method such as bar coater, air knife coater, blade coater, curtain coater and the like. The layer adjusting light-transmittance may be coated simultaneously with the thermal recording layer and the like. For example, after a coating solution used for forming the thermal recording layer is coated and dried, the coating solution for the layer adjusting light-transmittance may be coated on the layer to form the layer adjusting light-transmittance.

The dry coated amount of the layer adjusting light-transmittance is preferably 0.8 to 4.0 g/m$^2$.

(Protective Layer)

The protective layer can comprise pigments, lubricants, surfactants, dispersants, fluorescent whitening agents, metal soaps, film hardening agents, ultraviolet-ray absorbents, cross-linking agents, or the like in addition to a binder.

The binder can be properly selected from the following materials so long as it does not impair the barrier property and the operability of the binder: polyvinyl alcohols, methyl celluloses, carboxymethyl celluloses, hydroxyethyl celluloses, starches, gelatins, Arabic rubbers, caseins, hydrolysates of styrene-anhydride maleic acid copolymers, hydrolysates of ethylene-anhydride maleic acid copolymers, hydrolysates of isobutylene-anhydride maleic acid copolymers, polyvinylalcohols, denatured polyvinyl alcohols, polyacrylamides and the like.

In addition to the above-mentioned materials, other binders, such as synthetic rubber latexes, synthetic resin emulsions and the like, may be also used, and examples thereof include: styrene-butadiene rubber latexes, acrylonitrile-butadiene rubber latexes, methylacrylate-butadiene rubber latexes, vinylacetate emulsions and the like.

The content of the binder is preferably 10 to 500% by mass, more preferably, 50 to 400% by mass, with respect to the pigment in the protective layer.

Moreover, in order to further improve the water resistance, a cross-linking agent and a catalyst promoting the cross-linking reaction are effective in combination. Examples of the cross-linking agent include epoxy compounds, blocked isocyanates, vinylsulfone compounds, aldehyde compounds, methylol compounds, boric acids, carboxylic anhydrides, silane compounds, chelate compounds and halides, and those which can adjust the pH of the coating solution for forming the protective layer to 6.0 to 7.5 are preferable. For the catalyst, known acids and metal salts may be used, and those which can adjust the pH of the coating solution to 6.0 to 7.5 are preferable in the same manner.

For the pigment, all the known organic or inorganic pigments may be used, and specific examples include: calcium carbonates, aluminum hydroxides, barium sulfates, titanium oxides, talcs, agalmatolites, kaolins, calcined kaolins, amorphous silicas, colloidal silicas, urea formalin resin powders, polyethylene resin powders and benzoguanamine resin powders. One of these may be used alone, or two kinds or more may be used in combination.

Preferable examples of the lubricant include zinc stearates, calcium stearates, paraffin waxes and polyethylene waxes.

For the surfactant, which is used for forming a protective layer uniformly on the thermal recording layer, sulfosuccinic acid based alkali metal salts, fluorine-containing surfactants, and the like may be preferable, and specific examples thereof include sodium salts, ammonium salts and the like of di-(2-ethylhexyl)sulfosuccinates, di-(n-hexyl) sulfosuccinates and the like.

The coating solution for forming a protective layer (coating solution for the protective layer) is obtained by mixing the above-mentioned respective components. Further, a mold-releasing agent, wax, a water repellent agent, etc. may be added thereto, if necessary.

The heat-sensitive recording material of the present invention can be formed by coating a coating solution for the protective layer on the thermal recording layer formed on a substrate by a known coating method. Examples of known coating method include methods using a bar coater, an air knife coater, a blade coater, a curtain coater, and the like are listed.

Here, the protective layer may be formed simultaneously with the thermal recording layer and the layer adjusting light-transmittance. For example, after the coating solution for forming the thermal recording layer is coated and dried, the protective layer may be formed thereon.

The dry coated amount is preferably 0.2 to 7 g/m$^2$, more preferably, 1 to 4 g/m$^2$. If the dry coated amount is less than 0.2 g/m$^2$, it might be unable to maintain sufficient water resistance. If the dry coated amount exceeds 7 g/m$^2$, serious degradation in thermal sensitivity may occur. After coating and forming of the protective layer, the layers may be subjected to a calender process, if necessary.

(Intermediate Layer)

When a plurality of thermal recording layers are laminated, an intermediate layer is preferably formed between the respective thermal recording layers. In the same manner as the protective layer, the intermediate layer may contain pigments, a lubricant, a surfactant, a dispersant, a fluorescent whitening agent, metal soap, absorbent of ultraviolet-ray and the like, in addition to a binder. For the binder, the same binder as the protective layer may be used.

(Substrate)

Examples of the substrate include: polyethyleneterephthalates (PET), polyethylenenaphthalates (PEN), triacetylcelluloses (TAC), papers, papers laminated with plastic resin, synthetic papers and the like. Moreover, in order to obtain a transparent heat-sensitive recording material, it is necessary to use a transparent substrate. For the transparent substrate, examples thereof include polyester films such as polyethyleneterephthalates, polybutylenephthalates, and synthetic polymer films including triacetate cellulose films, polyolefin films such as polypropylenes, polyethylenes, and the like.

The substrate may be formed as a single layer or a laminated layer.

The thickness of the synthetic polymer film is preferably 25 to 300 $\mu$m, and more preferably, 100 to 250 $\mu$m.

The polymer films may be colored to a desired hue, and for the coloring method of polymer films, (1) a method which a dye is mixed and kneaded in a resin prior to film formation and the obtained mixture is formed into a film, (2) a method which a coating solution is prepared by dissolving a dye in an appropriate solvent and the solution is coated onto a colorless resin film by using a known coating method, such as a gravure coat method, a roller coat method or a wire coat method, and dried. Among these, a preferable film is obtained by forming a polyester resin, such as polyethyleneterephthalate or polyethylenenaphthalate, into which a blue dye is mixed and kneaded, into a film shape, and subjecting the obtained film to a heat-resistance applying process, a drawing process and a static-eliminating process.

The above-mentioned thermal recording layer, protective layer, layer adjusting light-transmittance, intermediate layer and the like may be formed by coating the respective coating solutions onto a substrate by using a known coating method such as a blade coating method, an air knife coating method, a gravure coating method, a roll coating method, a spray coating method, a dip coating method and a bar coating method, and drying the coated layer.

EXAMPLES

The following description will explain the present invention by means of examples; however, the present invention is not limited to these examples.

Example 1

Preparation of phthalated gelatin solution 32 parts by mass of phthalated gelatin (trade name: MGP gelatin, made by Nippi Collagen Co., Ltd., 0.9143 parts by mass of 1,2-benzothiazoline-3-on (3.5% methanol solution, made by Daito Chemical Industries, Ltd.), and 367.1 parts by mass of ion-exchanged water were mixed and dissolved at 40° C. to obtain a phthalated gelatin solution.

Preparation of gelatin solution processed by alkali 25.5 parts by mass of low ion gelatin processed by alkali (trade name: #750 gelatin, made by Nitta Gelatin Co., Ltd.), 0.7286 parts by mass of 1,2-benzothiazoline-3-on (3.5% methanol solution, made by Daito Chemical Industries, Co. Ltd.), 0.153 parts by mass of calcium hydroxide and 143.6 parts by mass of ion-exchanged water were mixed and dissolved at 50° C. to obtain a gelatin water solution processed by alkali. Preparation of coating solution (a) for yellow them-al recording layer (Preparation of microcapsules solution (a) containing diazonium salt compound)

2.2 parts by mass of a diazonium salt compound A (maximum absorbency wavelength 420 nm) described below, 2.2 parts by mass of a diazonium salt compound B (maximum absorbency wavelength 420 nm) described below, 2.4 parts by mass of monoisopropylbiphenyl, 3.6 parts by mass of diphenylphthalate (aromatic carboxylate represented by the general formula (I)), 3.6 parts by mass of the compound N-1(aromatic carboxylate represented by the general formula (II)), and 0.4 parts by mass of diphenyl(2,4,6-trimethylbenzoyl)phosphine oxide (trade name: Lucirin TPO, made by BASF Japan Ltd.; aromatic carboxylate represented by formula (II)) were added to 16.1 parts by mass of ethylacetate, and the solution was heated at 40° C. to be dissolved evenly.

8.6 parts by mass of a mixture of xylylenediisocyanate/trimethylol propane adduct and xylylenediisocyanate/bisphenol A adduct (trade name: Takenate D 119N (50% by mass ethylacetate solution, made by Takeda Chemical Industries, Ltd.) was added to the above-mentioned mixed solution, and the solution was stirred evenly to obtain a mixed solution (I).

Separately, 16.3 parts by mass of ion-exchanged water and 0.34 parts by mass of Scraph AG-8 (50% by mass, made by Nippon Fine Chemical Co., Ltd.) were added to 58.6 parts by mass of phthalated gelatin solution to obtain a mixed solution (II).

The mixed solution (I) was added to the mixed solution (II), and the resultant was emulsified and dispersed at 40° C. by using a homogenizer made by Nippon Seiki Seisakusho Co., Ltd. To the resulting emulsified solution was added 20 parts by mass of water, and this was mixed evenly. The resulting mixture was then subjected to a reaction for forming capsules for three hours, while being stirred at 40° C. so as to remove ethylacetate. Thereafter, 4.1 parts by mass of ion-exchange resin Amberlite IRA68 (made by Organo Corporation) and 8.2 parts by mass of Amberlite IRC50 (made by Organo Corporation) were further added to this mixture. The resulting solution was stirred for 1 hour, then filtrated to remove the ion exchange resin, and adjusted to 20.0% of the solid matter concentration in the capsule solution. Thus, microcapsule solution (a) of Example 1 containing diazonium salt compound was obtained. The particle size of the resulting microcapsules was 0.36 μm in median diameter as measured by an LA-700, made by Horiba, Ltd.

Diazonium salt compound A

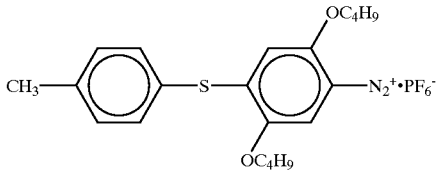

Diazonium salt compound B

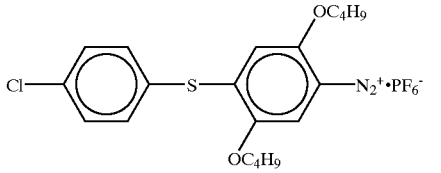

(Preparation of Emulsified Coupler Solution (a))

9.9 parts by mass of the following coupler C, 9.9 parts by mass of triphenylguanidine (made by Hodogaya Chemical Co., Ltd., 20.8 parts by mass of 4,4'-(m-phenylenediisopropylidene)diphenol (trade name: bisphenol M (Mitsui Petrochemical Industries, Ltd.)), 3.3 parts by mass of 3,3,3',3'-tetramethyl-5,5',6,6'-tetra(1-propyloxy)-1,1'-spirobisndane (made by Sankyo Chemical Industries, Ltd.), 13.6 parts by mass of 4-(2-ethyl-1-hexyloxy)benzene sulfonic acid amide (made by Manac Incorporated), 6.8 parts by mass of 4-n-pentyloxybenzene sulfonic acid amide (made by Manac Incorporated), and 4.2 parts by mass of calcium dodecylbenzenesulfonate (trade name: Pionin A-41-C, 70% methanol solution, made by Takemoto Oil&Fat Co., Ltd.) were dissolved in 33.0 parts by mass of ethylacetate to obtain a mixed solution (III).

Separately, 107.3 parts by mass of ion-exchanged water was mixed with 206.3 parts by mass of the above-mentioned alkali processed gelatin solution to obtain a mixed solution (IV).

Mixed solution (III) was added to mixed solution (IV), and the result emulsified and dispersed at 40° C. using a homogenizer (made by Nippon Seiki Seisakusho Co., Ltd.). The resulting emulsified coupler solution was heated under reduced pressure to remove ethylacetate therefrom, and adjusted to 26.5% by mass of the solid matter concentration. The particle size of the resulting emulsified coupler solution was 0.21 μm in median diameter as measured by an LA-700, made by Horiba, Ltd.

Moreover, to 100 parts by mass of the above-mentioned emulsified coupler solution was added 9 parts by mass of SBR latex (trade name: SN-307, 48% by mass solution, made by Sumika ABS Latex) which was adjusted to 26.5% by mass. The resultant was stirred evenly to obtain an emulsified coupler solution (a).

Coupler C

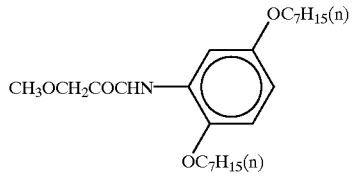

(Preparation of Coating Solution (a) for Yellow Thermal Recording Layer)

The microcapsule solution (a) containing diazonium salt compound and the emulsified coupler solution (a) were mixed to the mass ratio of coupler/diazonium salt compound to 2.2/1 to obtain coating solution (a) for yellow thermal recording layer.

Preparation of Coating Solution for Protective Layer 100 parts by mass of 6% by mass water solution of itaconic acid denatured polyvinylalcohol (KL-318, made by Kuraray Co., Ltd.) and 10 parts by mass of 30% by mass dispersed solution of epoxy denatured polyamide (FL-71, made by Toho Chemical Industry Co., Ltd.), were mixed. 15 parts by mass of zinc stearate of 15 parts by mass of 40% by mass dispersed solution (Hidrin Z, made by Chukyo Oil&Fat Co., Ltd.) evenly to the result to prepare a coating solution for a protective layer.

Application of coating Solution for Thermal Recording Layer

On a surface of a substrate for a print paper which is a high-quality paper laminated with polyethylene, the coating solution (a) for yellow thermal recording layer and the coating solution for protective layer were coated in this order using a wire bar, and dried at 50° C. to obtain the heat-sensitive recording material of Example 1. The coated amounts (solid components) of the coating solution (a) for a yellow thermal recording layer and the coating solution for a protective layer were 6.0 g/m$^2$ and 1.2 g/m$^2$, respectively.

Comparative Example 1

The same processes as Example 1 were carried out except that, in place of 3.6 parts by mass of diphenylphthalate (aromatic carboxylate represented by formula (I)) and 3.6 parts by mass of the above-exemplified compound N-1 (aromatic carboxylate represented by formula (II)) which had been used for preparing microcapsules solution (a) containing diazonium salt compound in Example 1, 7.2 parts by mass of diphenylphthalate was used to obtain microcapsules solution (a') containing diazonium salt compound and heat-sensitive recording material (a) of Comparative Example 1.

Comparative Example 2

The same processes as Example 1 were carried out except that, in place of 3.6 parts by mass of diphenylphthalate (aromatic carboxylate represented by formula (I)) and 3.6 parts by mass of the compound N-1(aromatic carboxylate represented by formula (II)), which had been used for preparing the microcapsules solution (a), 7.2 parts by mass of the compound N-1(aromatic carboxylate represented by formula (II)) was used to obtain a microcapsule solution (b'), which contains a diazonium salt compound, and a heat-sensitive recording material (b') of Comparative Example 2.

Comparative Example 3

The same processes as Example 1 were carried out except that, in place of 3.6 parts by mass of diphenylphthalate (aromatic carboxylate represented by formula (I)) and 3.6 parts by mass of the compound N-1(aromatic carboxylate represented by formula (II)), which had been used for preparing microcapsules solution (a), 7.2 parts by mass of monoisopropylbiphenyl was used to obtain microcapsules solution (c'), which contains a diazonium salt and a comparative-use heat-sensitive recording material (c') of Comparative Example 3.

Example 2

Preparation of Magenta Coating Solution (b) for Thermal Recording Layer (Preparation of microcapsules solution (b) containing diazonium salt compound)

2.8 parts by mass of diazonium salt compound D (maximum absorbency wavelength 365 nm) which will be described below, 4.0 parts by mass of diazonium salt compound B (maximum absorbency wavelength 420 nm) which will be described below, 4.0 parts by mass of diphenylphthalate (aromatic carboxylate represented by formula (I)), 4.0 parts by mass of the compound N-1(aromatic carboxylate represented by formula (II)), 1.5 parts by mass of monoisopropylbiphenyl, 1.5 parts by mass of tricresyl phosphate, 1.0 part by mass of di-n-butylsulfate, and 0.1 parts by mass of calcium dodecylbenzenesulfonate ((trade name: Pionin A-41-C, 70% methanol solution, made by Takemoto Oil & Fat Co., Ltd.) were added to 15.1 parts by mass of ethylacetate, and the solution was heated to be dissolved evenly. 2.5 parts by mass of a mixture of xylylenediisocyanate/trimethylol propane adduct and xylylenediisocyanate/bisphenol A adduct (trade name: Takenate D119N (50% by mass ethylacetate solution, made by Takeda Chemical Industries, Ltd.) and 6.8 parts by mass of xylylenediisocyanate/trimethylol propane adduct and xylylenediisocyanate/bisphenol A adduct (trade name: Takenate D110N (75% by mass ethylacetate solution, made by Takeda Chemical Industries, Ltd.), which served as capsule wall materials, was added to the mixed solution and the solution was stirred evenly to obtain a mixed solution (V).

Separately, 21.0 parts by mass of ion-exchanged water was added to 55.3 parts by mass of phthalated gelatin solution and mixed to obtain a mixed solution (VI).

Mixed solution (V) was added to mixed solution (VI), and the resultant was emulsified and dispersed at 40° C. using a homogenizer made by Nippon Seiki Seisakusho Co., Ltd. 20 parts by mass of water was added to the resulting emulsified solution, and mixed evenly. The result was then subjected to a reaction for forming capsules for three hours, while being stirred at 40° C. so as to remove ethylacetate. Thereafter, to the resultant 4.1 parts by mass of ion-exchange resin Amberlite IRA68 (made by Organo Corporation) and 8.2 parts by mass of Amberlite IRC50 (made by Organo Corporation) were further added to this result. The resulting solution was stirred for 1 hour, filtrated to remove the ion exchange resin, and adjusted to 20.0% of the solid matter concentration in the capsule solution. Thus, microcapsule solution (b) containing diazonium salt compound was obtained. The particle size of the resulting microcapsules was 0.50 μm in median diameter as measured by an LA-700, made by Horiba, Ltd.

Diazonium salt compound D

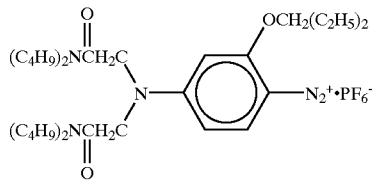

(Preparation of Emulsified Coupler Solution (b))

11.9 parts by mass of the following coupler E, 14.0 parts by mass of triphenylguanidine (made by Hodogaya Chemical Co., Ltd., 14.0 parts by mass of 4,4'-(m-phenylenediisopropylidene)diphenol (trade name; bisphenol M (Mitsui Petrochemical Industries, Ltd.)), 3.5 parts by mass of 3,3,3',3'-tetramethyl-5,5',6,6'-tetra(1-propyloxy)-1,1'-spirobisindane (made by Sankyo Chemical Industries, Ltd.), 3.5 parts by mass of the following compound G, 1.7 parts by mass of tricresyl phosphate, 0.8 parts by mass of diethylmaleate, and 4.2 parts by mass of calcium dodecylbenzenesulfonate (trade name: Pionin A-41-C, 70% methanol solution, made by Takemoto Oil & Fat Co., Ltd.) were dissolved in 36.9 parts by mass of ethylacetate to obtain a mixed solution (VII).

Separately, 107.3 parts by mass of ion-exchanged water was added to 206.3 parts by mass of the above-mentioned alkali processed gelatin solution to obtain a mixed solution (VIII).

Mixed solution (VII) was added to mixed solution (VIII), and the resultant was emulsified and dispersed at 40° C. using a homogenizer (made by Nippon Seiki Seisakusho Co., Ltd.). The resulting emulsified coupler solution was heated under reduced pressure to remove ethylacetate therefrom, and adjusted to 24.5% by mass of the solid matter concentration to obtain an emulsified coupler solution (b). The particle size of the resulting emulsified coupler solution was 0.22 μm in median diameter as measured by an LA-700, made by Horiba, Ltd.

Coupler E

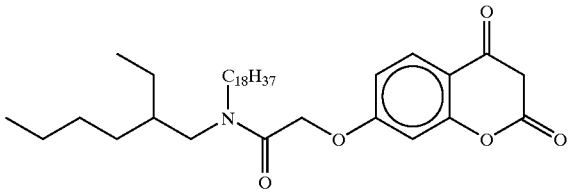

Compound G

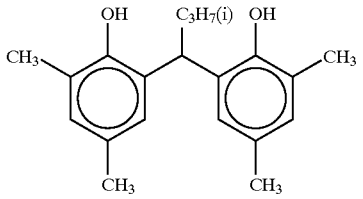

(Preparation of Magenta Coating Solution (b) for Thermal Recording Layer)

The microcapsule solution (b) containing diazonium salt compound and the emulsified coupler solution (b) were mixed with coupler/diazonium salt compound to amass ratio of 3.5/1. A water solution of polystyrene sulfonic acid (partially neutralized by potassium hydroxide type)(5% by mass) was mixed with the microcapsules solution (b) so as to account for 0.2 parts with respect to 10 parts thereof, thereby obtaining a coating solution (b) for magenta thermal recording layer.

Preparation of Coating Solution for Protective Layer 100 parts by mass of 6% by mass water solution of itaconic acid denatured polyvinylalcohol (KL-318, made by Kuraray Co., Ltd.) and 10 parts by mass of 30% by mass dispersed solution of epoxy denatured polyamide (FL-71, made by Toho Chemical Industry Co., Ltd.), were mixed. To the result 15 parts by mass of zinc stearate of 15 parts by mass of 40% by mass dispersed solution (Hidrin Z, made by Chukyo Oil & Fat Co., Ltd.) was added evenly to prepare a coating solution for a protective layer.

Coating of Coating Solution for Thermal Recording Layer

On a surface of a substrate for a print paper comprising high-quality paper laminated with polyethylene, the magenta coating solution (b) for a thermal recording layer and the coating solution for a protective layer were coated in this order using a wire bar, and dried at 50° C. to obtain the heat-sensitive recording material of Example 2. The coated amounts (solid components) of the magenta coating solution (b) for a thermal recording layer and the coating solution for protective layer were 9.0 g/m$^2$ and 1.2 g/m$^2$, respectively.

Comparative Example 4

The same processes as Example 2 were carried out except that, in place of 4.0 parts by mass of diphenylphthalate (aromatic carboxylate represented by formula (I)) and 4.0 parts by mass of the compound N-1(aromatic carboxylate represented by formula (II)) which had been used for preparing microcapsule solution (b) in Example 2, 8.0 parts by mass of diphenylphthalate was used to obtain a microcapsules solution (d') and a heat-sensitive recording material (d') of Comparative Example 4.

Comparative Example 5

The same processes as Example 2 were carried out except that, in place of 4.0 parts by mass of diphenylphthalate (aromatic carboxylate represented by formula (I)) and 4.0 parts by mass of the compound N-1(aromatic carboxylate represented by formula (II)), 8.0 parts by mass of the above-exemplified compound N-1(aromatic carboxylate represented by formula (II)) was used to obtain a microcapsule solution (e') and a heat-sensitive recording material (e') of Comparative Example 5.

Comparative Example 6

The same processes as Example 1 were carried out except that, in place of 4.0 parts by mass of diphenylphthalate (aromatic carboxylate represented by formula (I)) and 4.0 parts by mass of the compound N-1(aromatic carboxylate represented by formula (II)), 8.0 parts by mass of monoisopropylbiphenyl was used to obtain a microcapsule solution (f) and a heat-sensitive recording material (f') of Comparative Example 6.

<<Evaluation>>

(Evaluation of storage stability on microcapsule solution containing diazonium salt compound)

Each of the microcapsules solution containing diazonium salt compound obtained by the above-mentioned processes was stored at 5° C. Every 14 days from one day after the start of the storage, 500 g of the microcapsules solution containing diazonium salt compound was dissolved at 40° C., filtered by a sieve with 420 mesh, and the dried mass of the residue remaining on the sieve was measured. Table 1 shows the results of the measurements.

(Evaluation of Heat-sensitive Recording Material)

The densities on image portions and non-image portions (base surface density; yellowing) of the respective heat-sensitive recording so materials obtained from the above-mentioned processes were evaluated by using the following method.

(1) After the printing power and pulse width had been adjusted to have printing energy of 35 to 40 mJ/mm$^2$ per unit area, the respective heat-sensitive recording materials were thermally printed to form images using a thermal head KST-type (made by Kyosera Corporation). Photo-fixing was carried out by irradiating for 10 seconds using an ultraviolet-ray lamp (output 40 W), which was set to a light-emission center wavelength of 420 nm for the heat-sensitive recording materials of Example 1 and Comparative Examples 1 to 3, and to 365 nm for the heat-sensitive recording materials of Example 2 and Comparative Examples 4 to 6. Then, 10 minutes after the photo-fixing process, the optical reflection densities on color-developed portions and base-surface portions of the resulting images (color-developed portions were yellow in Example 1 and Comparative Examples 1 to 3, magenta in Example 2 and Comparative Examples 4 to 6 and base-surface portions were yellow) were measured by an X-rite densitometer. Table 2 shows the results of the measurements.

(2) Separately, respective unrecorded heat-sensitive recording materials were left in a thermo-hydrostat adjusted to 60° C. with a relative humidity of 30% for 72 hours to occur a forced degradation process. Then, the photo-fixing process was carried out thereon under the same conditions as in the method (1), and 10 minutes later, the optical reflection yellow density on base surface portions was measured by an X-rite densitometer. Table 2 shows the results of the measurements.

TABLE 1

| | Change in residue amount during microcapsules storage (g) | | | | | |
|---|---|---|---|---|---|---|
| | After one day | After 14 days | After 28 days | After 42 days | After 56 days | After 70 days |
| Example 1 | 0.004 | 0.005 | 0.004 | 0.005 | 0.007 | 0.006 |
| Example 2 | 0.003 | 0.004 | 0.003 | 0.005 | 0.004 | 0.005 |
| Comparative Example 1 | 0.005 | 0.006 | 0.014 | 0.019 | 0.052 | 0.095 |
| Comparative Example 2 | 0.005 | 0.005 | 0.015 | 0.024 | 0.063 | 0.103 |
| Comparative Example 3 | 0.004 | 0.005 | 0.004 | 0.006 | 0.005 | 0.006 |

TABLE 1-continued

| | Change in residue amount during microcapsules storage (g) | | | | | |
|---|---|---|---|---|---|---|
| | After one day | After 14 days | After 28 days | After 42 days | After 56 days | After 70 days |
| Comparative Example 4 | 0.004 | 0.006 | 0.008 | 0.015 | 0.037 | 0.077 |
| Comparative Example 5 | 0.005 | 0.005 | 0.012 | 0.021 | 0.043 | 0.089 |
| Comparative Example 6 | 0.003 | 0.003 | 0.005 | 0.004 | 0.006 | 0.006 |

TABLE 2

| | Density value | | |
|---|---|---|---|
| | After recording | | Base surface portion |
| | Image portion | Base surface portion | after a forced degradation process |
| Example 1 | 1.59 | 0.07 | 0.09 |
| Example 2 | 1.65 | 0.07 | 0.09 |
| Comparative Example 1 | 1.57 | 0.07 | 0.10 |
| Comparative Example 2 | 1.58 | 0.07 | 0.09 |
| Comparative Example 3 | 1.56 | 0.11 | 0.16 |
| Comparative Example 4 | 1.65 | 0.07 | 0.10 |
| Comparative Example 5 | 1.64 | 0.07 | 0.10 |
| Comparative Example 6 | 1.63 | 0.12 | 0.17 |

As shown in Tables 1 and 2, the heat-sensitive recording materials of Examples 1 and 2, in which diazonium salt compound, aromatic carboxylate represented by formula (I) and aromatic carboxylate represented by formula (II) were both encapsulated in microcapsules, reduced the base surface density (yellow colored) without deteriorating the density in image portions. Moreover, since the change in the amount of residue in the resulting microcapsule solution containing diazonium salt compound after storage was small, it is shown that crystallization therein is suppressed.

In contrast, in Comparative Examples 1, 2, 4 and 5, in which only one of an aromatic carboxylate represented by formula (I) and an aromatic carboxylate represented by formula (II) was included in microcapsules together with diazonium salt compound, the base surface density (yellow colored) of the heat-sensitive recording material was reduced. However, the amount of residue in the resulting microcapsules solution containing diazonium salt compound after storage increased.

Moreover, in the case of Comparative Examples 3 and 6 in which neither an aromatic carboxylate represented by formula (I) nor an aromatic carboxylate represented by formula (II) was used, although the amount of residues in the resulting microcapsules solution containing diazonium salt compound after storage was small, the base surface density (yellow colored) of the heat-sensitive recording material was high.

The present invention is able to provide a heat-sensitive recording material which is superior in the whiteness on non-image portions (base surface portions) and storage stability (shelf life) of the whiteness, makes it possible to provide clear images with high contrast in a stable manner without causing deterioration of the color developing density in image portions, and is also superior in production efficiency, and a microcapsule solution which is superior in the storage stability with suppressed crystallization.

What is claimed is:

1. A heat-sensitive recording material comprising:

a substrate; a thermal recording layer disposed on said substrate, which thermal recording layer contains a diazonium salt compound and a coupler that has a coupling reaction with the diazonium salt compound to develop a color; an aromatic carboxylate represented by the following general formula (I); and an aromatic carboxylate represented by the following general formula (II);

wherein the diazonium salt compound is encapsulated in microcapsules together with the aromatic carboxylate represented by the general formula (I) and the aromatic carboxylate represented by the general formula (II);

General formula (I)

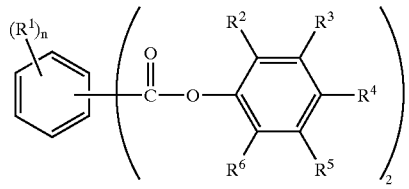

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4;

General formula (II)

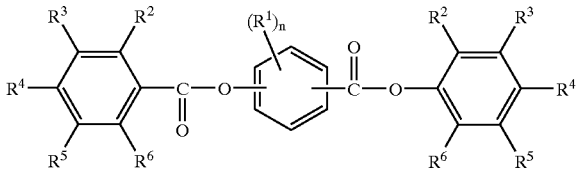

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4.

2. The material of claim 1, wherein the mass ratio (x/y) of the aromatic carboxylate (x) represented by the general formula (I) to the aromatic carboxylate (y) represented by the general formula (II) comprises 30/70 to 70/30.

3. The material of claim 1, wherein the melting points of each of the aromatic carboxylates is not more than 150° C.

4. The material of claim 1, wherein a total amount of the aromatic carboxylate comprises 50 to 500% by mass relative to the diazonium salt compound.

5. The material of claim 1, said microcapsules further comprising one kind of at least thermal acid-generating agent selected from arylalkylsulfonyl compounds and dialkyl sulfate compounds.

6. The material of claim 5, wherein a total amount of the thermal acid-generating agent is 10 to 200% by mass relative to the diazonium salt compound.

7. The material of claim 1, wherein the microcapsules are manufactured by an interface polymerization method.

8. The material of claim 1, wherein a particle size of the microcapsules is 0.1 to 2.0 $\mu$m.

9. The material of claim 1, wherein an amount of the coupler in the thermal recording layer is 0.1 to 30 parts by mass relative to 1 part by mass of diazonium salt compound.

10. The material of claim 1, wherein a coated amount of the diazonium compound in the thermal recording layer is 0.05 to 2 g/m$^2$.

11. The material of claim 1, wherein the thermal recording layer further comprises an organic base, an intensifier, a binder and an antioxidant.

12. A microcapsule solution for comprising an aromatic carboxylate represented by the following general formula (I), an aromatic carboxylate represented by the following general formula (II), and a diazonium salt compound in microcapsules of the microcapsule solution;

General formula (I)

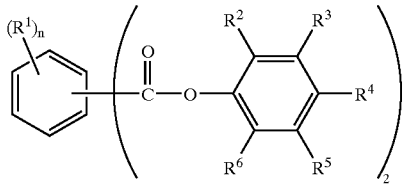

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4;

General formula (II)

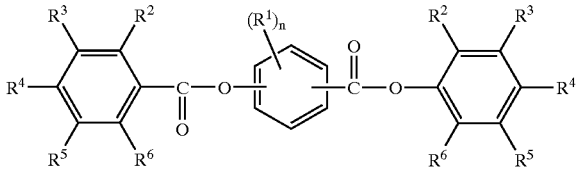

in which $R^1$ represents one of a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, an alkyloxycarbonyl groups having 2 to 20 carbon atoms, a cycloalkyl groups having 5 to 20 carbon atoms and an aryl groups having 6 to 20 carbon atoms; each of $R^2$, $R^3$, $R^4$, $R^5$ and $R^6$ independently represents one of a hydrogen atom, a halogen atom, an alkyl groups having 1 to 20 carbon atoms, an alkenyl groups having 2 to 20 carbon atoms, an aralkyl groups having 7 to 20 carbon atoms, an alkoxy groups having 1 to 20 carbon atoms, an alkylcarbonyl groups having 2 to 20 carbon atoms, an alkylcarbonyloxy groups having 2 to 20 carbon atoms, a cycloalkyl groups having 5 to 20 carbon atoms, and an aryl groups having 6 to 20 carbon atoms; and n represents an integer of 0 to 4.

13. The microcapsule solution of claim 12, wherein the mass ratio (x/y) of the aromatic carboxylate (x) represented by the general formula (I) to the aromatic carboxylate (y) represented by the general formula (II) is 30/70 to 70/30.

14. The microcapsule solution of claim 12, wherein a melting point of the aromatic carboxylate in the microcapsule solution is not more than 150° C.

15. The microcapsule solution of claim 12, wherein a total amount of the aromatic carboxylate comprises 50 to 500% by mass relative to the diazonium salt compound.

16. The microcapsule solution of claim 12, further comprising, in the microcapsules, at least one kind of thermal acid-generating agent selected from arylalkylsulfonyl compounds and dialkyl sulfate compounds.

17. The microcapsule solution of claim 16, wherein a total amount of the thermal acid-generating agent is 10 to 200% by mass, relative to the diazonium salt compound.

18. The microcapsule solution of claim 12, wherein the microcapsules are manufactured by an interface polymerization method.

19. The microcapsule solution of claim 12, wherein a particle size of the microcapsules is 0.1 to 2.0 $\mu$m.

* * * * *